US006048675A

United States Patent [19]

Hirano et al.

[11] Patent Number: 6,048,675

[45] **Date of Patent: *Apr. 11, 2000**

[54] METHOD FOR PROCESSING SILVER HALIDE PHOTOGRAPHIC MATERIAL

[75] Inventors: Mitsunori Hirano; Kohzaburoh Yamada, both of Kanagawa, Japan

[73] Assignee: Fuji Photo Film Co., Ltd., Kanagawa, Japan

[ * ] Notice: This patent is subject to a terminal disclaimer.

[21] Appl. No.: 08/979,929

[22] Filed: Nov. 26, 1997

[30] Foreign Application Priority Data

Nov. 26, 1996 [JP] Japan ..... 8-314617

[51] Int. Cl.[7] ..... G03C 5/29

[52] U.S. Cl. ..... 430/434; 430/438; 430/440; 430/445; 430/446; 430/488

[58] Field of Search ..... 430/436, 438, 430/440, 445, 446, 488

[56] References Cited

U.S. PATENT DOCUMENTS

| | | | |
|---|---|---|---|
| 5,300,410 | 4/1994 | Date et al. | 430/488 |
| 5,356,761 | 10/1994 | Morimoto et al. | 430/488 |
| 5,385,811 | 1/1995 | Hirano | 430/438 |
| 5,441,847 | 8/1995 | Fukawa et al. | 430/488 |
| 5,506,092 | 4/1996 | Ishikawa et al. | 430/488 |
| 5,508,153 | 4/1996 | Ishikawa et al. | 430/488 |
| 5,523,196 | 6/1996 | Iwashita et al. | 430/488 |
| 5,691,108 | 11/1997 | Hirano et al. | 430/488 |
| 5,804,358 | 9/1998 | Komatsu et al. | 430/488 |
| 5,840,472 | 11/1998 | Sasaki et al. | 430/488 |

*Primary Examiner*—Hoa Van Le

*Attorney, Agent, or Firm*—Sughrue, Mion, Zinn, Macpeak & Seas, PLLC

[57] ABSTRACT

A development processing method comprising a step of developing a silver halide photographic material having at least one silver halide emulsion layer with a developing solution containing a hydroquinone developing agent, wherein said developing solution has a pH of from 9.0 to 11.0, and contains a compound represented by formula (I) and a compound represented by formula (II) in a concentration ratio of the compound represented by formula (II)/the hydroquinone developing agent of from 0.03 to 0.12:

(I)

(II)

wherein the symbols in these formulae are defined in the specification.

8 Claims, No Drawings

METHOD FOR PROCESSING SILVER HALIDE PHOTOGRAPHIC MATERIAL

FIELD OF THE INVENTION

The present invention relates to a method for development processing a silver halide photographic light-sensitive material (hereinafter referred to as "light-sensitive material" or "photographic material"). More specifically, the present invention relates to a method for development processing a black-and-white photographic material for general use, a black-and-white photographic material for printing, and an X-ray black-and-white photographic material for medical and industrial use with a developing solution having a pH of from not less than 9.0 to less than 11.0.

BACKGROUND OF THE INVENTION

In development processing of a photographic material, in general, the case where an automatic developing machine (hereinafter referred to as "automatic processor") is used has increased for its rapidity, easiness and handleability. In recent years, requirements for the reduction of replenishing rate in development processing and the speed-up of development processing have increased more and more. One means to satisfy these requirements is to increase the activity of a developing solution. In processing a black-and-white photographic material, the activity can be enhanced by increasing the concentration of a developing agent, but it causes extreme deterioration of the developing solution due to air oxidation. Further, reduction of the film thickness of a photographic material (e.g., a protective layer) is also effective for rapid processing.

The use of sulfite for preventing the deterioration of a developing solution has been known for long but sulfite has a function of dissolving a silver halide, therefore, silver is dissolved out as a sulfite silver complex from a photographic material into a developing solution. This silver complex is reduced in the developing solution and adheres to a developing tank and a roller and gradually accumulates. This is called silver stain or silver sludge, which necessitates periodical cleaning and maintenance of the instrument because it adheres to the photographic material to be processed and contaminates images or the automatic processor.

As a method of diminishing such silver stain, methods of adding compounds which depress silver ions dissolving into a developing solution and/or restraining the reduction of silver ion to silver as disclosed in JP-A-56-24347 and JP-A-8-6215 (the term "JP-A" as used herein means an "unexamined published Japanese patent application") are known. However, to obtain sufficient silver stain-preventing effect by such methods, the addition amount of the former compound should be increased, which causes harmful influences on photographic characteristics such as desensitization and increase of fog. Such disadvantageous influences are remarkable, in particular, in an ultrahigh contrast photographic material containing a hydrazine compound. Further, with respect to the latter compound, although contamination of the lack and the tank of an automatic processor is effectively prevented because of its high reduction-restraining capability, but when a photographic material is practically processed, the reduction at the contact place of a roller and a photographic material where the silver concentration is locally high cannot be prevented sufficiently. Therefore, silver precipitates on a roller. This adheres to a photographic material and causes silver stain.

On the other hand, the addition of an ascorbic acid to a developing solution is already known. An ascorbic acid is used as a developing agent in many cases as disclosed in British Patents 956,368 and 1,030,495, U.S. Pat. No. 2,688,549 and JP-B-36-17599 (the term "JP-B" as used herein means an "examined Japanese patent publication"). In these patents or publications, an ascorbic acid is used as a developing agent and a hydroquinone derivative is not contained in the developing solution. The effects of these inventions are different from the effect of an ascorbic acid according to the present invention. If an ascorbic acid is added to an alkaline developing solution in an amount of 0.15 mol or more, there arises a problem such that the ascorbic acid is air oxidized and the pH lowers at hydrolysis, and the activity of the developing solution decreases.

A combined use of a hydroquinone derivative and an ascorbic acid are disclosed, e.g., in U.S. Pat. No. 3,512,981, JP-B-55-49298 and British Patent 1,326,495, but these patents are directed to a lith type development system of a photomechanical process, in which free sulfite ion concentration is low. Therefore, there is a problem that the preservability of a developing solution is not stable.

A combined use of a hydroquinone derivative, an ascorbic acid and a 1-phenyl-3-pyrazolidone derivative in a developing solution is disclosed in U.S. Pat. No. 3,865,591, but the ascorbic acid in this patent functions as a developing agent, and there are no descriptions about the effects of the ascorbic acid in the present invention. Further, because the pH of the developer in the above patent is as low as from 8 to 9.5, the activity is low. Thus, the above developing solution is differently aimed at from the present invention.

SUMMARY OF THE INVENTION

An object of the present invention is to provide a method for processing a silver halide photographic material which reduces the generation of silver stain in development processing with a stable developing solution having a pH of from not less than 9.0 to less than 11.0 even at a low replenishing rate of the developing solution.

Other objects and effects of the present invention will become apparent from the following description.

The above objects of the present invention have been achieved by providing:

a development processing method comprising a step of developing a silver halide photographic material having at least one silver halide emulsion layer with a developing solution containing a hydroquinone developing agent, wherein the developing solution has a pH of from 9.0 to 11.0, and contains a compound represented by formula (I) and a compound represented by formula (II) in a concentration ratio of the compound represented by formula (II)/the hydroquinone developing agent of from 0.03 to 0.12:

(I)

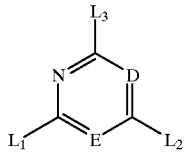

wherein D and E each represents a —CH═ group, a —C($R_0$)═ group or a nitrogen atom; $R_0$ represents a substituent; $L_1$, $L_2$ and $L_3$ may be the same or different and each represents a hydrogen atom, a halogen atom or a substituent which is bonded to the ring in formula (I) by a carbon atom, a nitrogen atom, an oxygen atom, a sulfur atom or a phosphorus atom contained in the substituent, provided that at least one of $L_1$, $L_2$, $L_3$ and $R_0$ represents an —SM group (M represents an alkali metal atom, a hydrogen atom or an ammonium group), and provided that when one of E and D represents a nitrogen atom and the other represents the carbon-containing group (a —CH═ group or a —C($R_0$)═ group), E represents a nitrogen atom and D represents the carbon-containing group and neither $L_2$ nor $L_3$ represents a hydroxyl group;

(II)

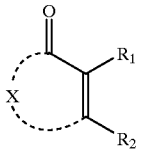

wherein $R_1$ and $R_2$ each represents a hydroxyl group, an amino group, an acylamino group, an alkylsulfonylamino group, an arylsulfonylamino group, an alkoxycarbonylamino group, a mercapto group or an alkylthio group; and X comprises at least one of a carbon atom, an oxygen atom and a nitrogen atom and forms a 5- or 6-membered ring together with the two vinyl carbon on which $R_1$ and $R_2$ are substituted and the carbonyl carbon.

DETAILED DESCRIPTION OF THE INVENTION

The compounds for use in the present invention are described in detail below.

The addition amount of the compound represented by formula (I) is from 0.01 to 10 mmol, preferably from 0.1 to 5 mmol, per liter of the working solution.

The compound represented by formula (I) is described in detail below.

In formula (I), D and E each represents a —CH═ group, a —C($R_0$)═ group or a nitrogen atom, $R_0$ represents a substituent, $L_1$, $L_2$ and $L_3$ each represents a hydrogen atom, a halogen atom or a substituent which is bonded to the ring in formula (I) by a carbon atom, a nitrogen atom, an oxygen atom, a sulfur atom or a phosphorus atom contained in the substituent, $L_1$, $L_2$ and $L_3$ may be the same or different, provided that at least one of $L_1$, $L_2$, $L_3$ and $R_0$ represents an —SM group (M represents an alkali metal atom, a hydrogen atom or an ammonium group), and provided that when one of E and D represent a nitrogen atom and the other represents the carbon-containing group (a —CH═ group or a —C($R_0$)═ group), E represents a nitrogen atom and D represents the carbon-containing group (a —CH═ group or a —C($R_0$)═ group) and in this case $L_2$ and $L_3$ do not represent hydroxyl groups.

Specific examples of the substituent represented by $L_1$, $L_2$ and $L_3$ and the substituent represented by $R_0$ include a halogen atom (e.g., fluorine, chlorine, bromine, iodine), an alkyl group (including aralkyl, cycloalkyl, active methine), an alkenyl group, an alkynyl group, an aryl group, a heterocyclic group, a heterocyclic group containing a quaternized nitrogen atom (e.g., pyridinio), an acyl group, an alkoxycarbonyl group, an aryloxycarbonyl group, a carbamoyl group, a carboxyl group or a salt thereof, a sulfonylcarbamoyl group, an acylcarbamoyl group, a sulfamoylcarbamoyl group, a carbazoyl group, an oxalyl group, an oxamoyl group, a cyano group, a thiocarbamoyl group, a hydroxyl group, an alkoxyl group (including a group having a repeating unit of ethyleneoxy or propyleneoxy), an aryloxy group, a heterocyclic oxy group, an acyloxy group, an alkoxy- or aryloxycarbonyloxy group, a carbamoyloxy group, a sulfonyloxy group, an amino group, an alkyl-, aryl- or heterocyclic amino group, a hydroxyamino group, an N-substituted saturated or unsaturated nitrogen-containing heterocyclic group, an acylamino group, a sulfonamido group, a ureido group, a thioureido group, an imido group, an alkoxy- or aryloxycarbonylamino group, a sulfamoylamino group, a semicarbazido group, a thiosemicarbazido group, a hydrazino group, a quaternary ammonio group, an oxamoylamino group, an alkyl- or arylsulfonylureido group, an acylureido group, an acylsulfamoylamino group, a nitro group, a mercapto group, an alkyl-, aryl- or heterocyclic thio group, an alkyl- or arylsulfonyl group, an alkyl- or arylsulfinyl group, a sulfo group or a salt thereof, a sulfamoyl group, an acylsulfamoyl group, a sulfonylsulfamoyl group or a salt thereof, and a group having phosphoric acid amide or phosphate structure.

These substituents may further be substituted with these substituents.

When E represents a nitrogen atom and D represents the carbon-containing group (i.e., a —CH═ group or a —C($R_0$)═ group), neither $L_2$ nor $L_3$ represents a hydroxyl group.

More preferred of the substituent represented by $L_1$, $L_2$ and $L_3$ and the substituent represented by $R_0$ are substituents having from 0 to 15 carbon atoms, e.g., a chlorine atom, an alkyl group, an aryl group, a heterocyclic group, an acyl group, an alkoxycarbonyl group, a carbamoyl group, a carboxyl group or a salt thereof, a cyano group, an alkoxyl group, an aryloxy group, an acyloxy group, an amino group, an alkyl-, aryl- or heterocyclic amino group, a hydroxyamino group, an N-substituted saturated or unsaturated nitrogen-containing heterocyclic group, an acylamino group, a sulfonamido group, a ureido group, a thioureido group, a sulfamoylamino group, a nitro group, a mercapto group, an alkyl-, aryl- or heterocyclic thio group, a sulfo group or a salt thereof, and a sulfamoyl group, still more preferred are an alkyl group, an aryl group, a heterocyclic group, an alkoxycarbonyl group, a carbamoyl group, a carboxyl group or a salt thereof, an alkoxyl group, an aryloxy group, an acyloxy group, an amino group, an alkyl-, aryl- or heterocyclic amino group, a hydroxyamino group, an N-substituted saturated or unsaturated nitrogen-containing heterocyclic group, an acylamino group, a sulfonamido group, a ureido group, a thioureido group, a sulfamoylamino group, a mercapto group, an alkyl-, aryl- or heterocyclic thio group, and a sulfo group or a salt thereof, and most preferred are an amino group, an alkyl group, an aryl group, an alkoxyl group, an aryloxy group, an alkylamino group, an arylamino group, an alkylthio group, an arylthio group, a mercapto group, a carboxyl group or a salt thereof, and a sulfo group or a salt thereof.

In formula (I), $L_1$, $L_2$ and $L_3$ and $R_0$ may be bonded to each other to form a condensed ring of a hydrocarbon ring, a heterocyclic ring or an aromatic ring with the ring in formula (I).

In formula (I), M represents an alkali metal atom, a hydrogen atom or an ammonium group. An alkali metal atom is specifically Na, K, Li, Mg or Ca, and these atoms are present as a counter cation of —$S^-$. M preferably represents an oxygen atom, an ammonium group, $Na^+$ or $K^+$, and particularly preferably an oxygen atom. of the compounds represented by formula (I), those represented by the following formula (A) or (B) are preferred.

(A)

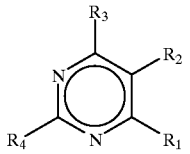

(B)

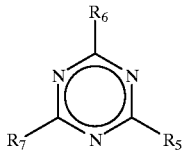

The compound represented by formula (A) is described in detail below.

$R_1$, $R_2$, $R_3$ and $R_4$ each represents a hydrogen atom, a halogen atom or a substituent which is bonded to the ring by a carbon atom, a nitrogen atom, an oxygen atom, a sulfur atom or a phosphorus atom contained in the substituent. They have the same meaning with $L_1$, $L_2$ and $L_3$ in formula (I) and the preferred range of the substituent is also the same, provided that $R_1$ and $R_3$ do not represent hydroxyl groups. $R_1$ to $R_4$ may be the same or different, but at least one of them represents an —SM group. M represents a hydrogen atom, an alkali metal atom or an ammonium group.

In formula (A), at least one of $R_1$ to $R_4$ represents an —SM group, more preferably at least two of $R_1$ to $R_4$ represent —SM groups. When at least two of $R_1$ to $R_4$ are —SM groups, preferably $R_4$ and $R_1$, or $R_4$ and $R_3$ represent —SM groups.

In the present invention, particularly preferred compounds represented by formula (A) are those represented by the following formula (A-1), (A-2) or (A-3):

(A-1)

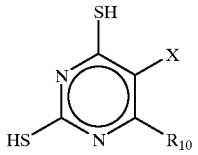

(A-2)

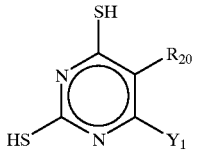

(A-3)

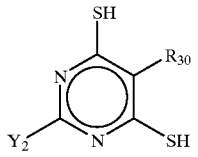

In formula (A-1), $R_{10}$ represents a mercapto group, a hydrogen atom or a substituent, and X represents a water-soluble group or a substituent substituted with a water-soluble group. In formula (A-2), $Y_1$ represents a water-soluble group or a substituent substituted with a water-soluble group, and $R_{20}$ represents a hydrogen atom or a substituent. In formula (A-3), $Y_2$ represents a water-soluble group or a substituent substituted with a water-soluble group, and $R_{30}$ represents a hydrogen atom or a substituent, provided that $R_{10}$ and $Y_1$ each does not represent a hydroxyl group.

The compound represented by formula (A-1), (A-2) or (A-3) is described in detail below.

In formula (A-1), $R_{10}$ represents a mercapto group, a hydrogen atom or a substituent.

The substituent represented by $R_{10}$ includes the same substituents as described for $R_1$ to $R_4$ in formula (A). $R_{10}$ preferably represents a mercapto group, a hydrogen atom, or a group selected from the following substituents having from 0 to 15 carbon atoms, e.g., an amino group, an alkyl group, an aryl group, an alkoxyl group, an aryloxy group, an acylamino group, a sulfonamido group, an alkylthio group, an arylthio group, an alkylamino group, or an arylamino group.

In formula (A-1), X represents a water-soluble group or a substituent substituted with a water-soluble group. The water-soluble group is a sulfonic acid, a carboxylic acid or a salt of these acids, a salt such as an ammonio group, or a group containing a dissociative group partially or completely dissociable by an alkaline developing solution, specifically a sulfo group (or a salt thereof), a carboxyl group (or a salt thereof), a hydroxyl group, a mercapto group, an amino group, an ammonio group, a sulfonamido group, an acylsulfamoyl group, a sulfonylsulfamoyl group, an active methine group, or a substituent containing any of these groups. The active methine group in the present invention means a methyl group substituted with two electron attractive groups, specifically dicyanomethyl, α-cyano-α-ethoxycarbonylmethyl and α-acetyl-α-ethoxycarbonylmethyl can be cited.

The substituent represented by X in formula (A-1) is the above-described water-soluble group or a substituent substituted with the above-described water-soluble group and the substituent in the substituted water-soluble group has from 0 to 15 carbon atoms, e.g., an alkyl group, an aryl group, a heterocyclic group, an alkoxyl group, an aryloxy group, a heterocyclic oxy group, an acyloxy group, an alkyl-, aryl- or heterocyclic amino group, an acylamino group, a sulfonamido group, a ureido group, a thioureido group, an imido group, a sulfamoylamino group, an alkyl-, aryl- or heterocyclic thio group, an alkyl- or arylsulfonyl group, a sulfamoyl group, or an amino group, preferably having from 1 to 10 carbon atoms, e.g., an alkyl group (in particular, a methyl group substituted with an amino group), an aryl group, an aryloxy group, an amino group, an alkyl-, aryl- or heterocyclic amino group, or an alkyl-, aryl- or heterocyclic thio group.

The compound represented by formula (A-1) is more preferably represented by the following formula (A-1-a):

(A-1-a)

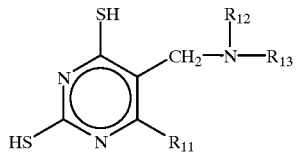

wherein $R_{11}$ has the same meaning as $R_{10}$ in formula (A-1) and the preferred range of the substituent is also the same.

$R_{12}$ and $R_{13}$, which may be the same or different, each represents a hydrogen atom, an alkyl group, an aryl group or a heterocyclic group, provided that at least one of $R_{12}$ and $R_{13}$ has a water-soluble group. The water-soluble group herein is a sulfo group (or a salt thereof), a carboxyl group (or a salt thereof), a hydroxyl group, a mercapto group, an amino group, an ammonio group, a sulfonamido group, an acylsulfamoyl group, a sulfonylsulfamoyl group, an active methine group, or a substituent containing any of these groups, preferably a sulfo group (or a salt thereof), a carboxyl group (or a salt thereof), a hydroxyl group or an amino group.

$R_{12}$ and $R_{13}$ each preferably represents an alkyl group or an aryl group. When $R_{12}$ and $R_{13}$ each represents an alkyl group, the alkyl group is preferably a substituted or unsubstituted alkyl group having from 1 to 4 carbon atoms, and the substituent thereof include a water-soluble group, particularly preferably a sulfo group (or a salt thereof), a carboxyl group (or a salt thereof), a hydroxyl group or an amino group. When $R_{12}$ and $R_{13}$ each represents an aryl group, the aryl group is preferably a substituted or unsubstituted phenyl group having from 6 to 10 carbon atoms, and the substituent thereof include a water-soluble group, particularly preferably a sulfo group (or a salt thereof), a carboxyl group (or a salt thereof), a hydroxyl group or an amino group.

When $R_{12}$ and $R_{13}$ each represents an alkyl group or an aryl group, they may be bonded to each other to form a cyclic structure. A saturated heterocyclic ring may be formed by the cyclic structure.

In formula (A-2), $Y_1$ represents a water-soluble group or a substituent substituted with a water-soluble group, and $Y_1$ has the same meaning as X in formula (A-1). As the water-soluble group or the substituent substituted with a water-soluble group represented by $Y_1$ in formula (A-2), preferred are an active methine group, or the following group substituted with a water-soluble group, e.g., an amino group, an alkoxyl group, an aryloxy group, an alkylthio group, an arylthio group, an alkyl group or an aryl group. $Y_1$ more preferably represents an active methine group, or an alkyl-, aryl- or heterocyclic amino group substituted with a water-soluble group, in which the water-soluble group is particularly preferably a hydroxyl group, a carboxyl group or a salt thereof, or a sulfo group or a salt thereof.

Particularly preferred Y, includes an alkyl-, aryl- and heterocyclic amino groups each substituted with a hydroxyl group, a carboxyl group (or a salt thereof) or a sulfo group (or a salt thereof), which is represented by an —$N(R_{01})(R_{02})$ group. $R_{01}$ and $R_{02}$ each has the same meaning as $R_{12}$ and $R_{13}$ in formula (A-1-a) and the preferred range of the substituent is also the same.

In formula (A-2), $R_{20}$ represents a hydrogen atom or a substituent, and the substituent herein includes the same substituents as described for $R_1$ to $R_4$ in formula (A). $R_{20}$ preferably represents a hydrogen atom or a group selected from the following substituents having from 0 to 15 carbon atoms, e.g., a hydroxyl group, an amino group, an alkyl group, an aryl group, an alkoxyl group, an aryloxy group, an acylamino group, a sulfonamido group, an alkylthio group, an arylthio group, an alkylamino group, an arylamino group, or a hydroxylamino group. $R_{20}$ most preferably represents a hydrogen atom.

In formula (A-3), $Y_2$ represents a water-soluble group or a substituent substituted with a water-soluble group, and $R_{30}$ represents a hydrogen atom or a substituent. $Y_2$ and $R_{30}$ in formula (A-3) have the same meaning as $Y_1$ and $R_{20}$ in formula (A-2), respectively, and the preferred ranges of the substituents are also the same.

The compound represented by formula (B) is described in detail below.

$R_5$, $R_6$ and $R_7$ in formula (B) have the same meaning as $R_1$ to $R_4$ in formula (A), and the preferred ranges of the substituents are also the same. The compound represented by formula (B) is particularly preferably represented by formula (B-1).

(B-1)

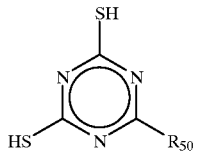

wherein $R_{50}$ has the same meaning as $R_5$ to $R_7$ in formula $(B)_1$ more preferably $R_{50}$ is the same water-soluble group or substituent substituted with a water-soluble group represented by X, $Y_1$ and $Y_2$ in formulae (A-1), (A-2) and (A-3). The compound represented by formula (B-1) is most preferably represented by formula (B-1-a).

(B-1-a)

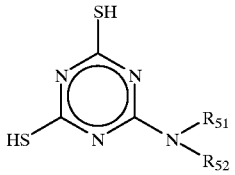

wherein $R_{51}$ and $R_{52}$ have the same meaning as $R_{12}$ and $R_{13}$ in formula (A-1-a) and the preferred ranges of the substituents are also the same.

Specific examples of the compounds represented by formula (I) according to the present invention are shown below but it should not be construed as the present invention is limited thereto.

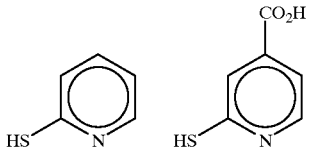

1.

2.

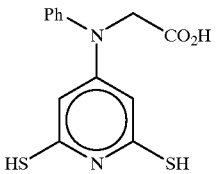

3.

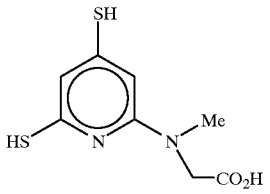

4.

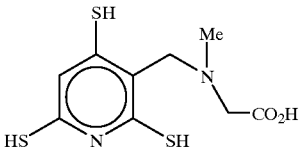

5.

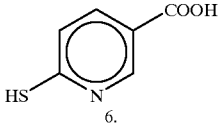

6.

-continued
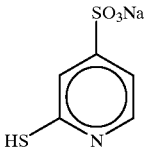
7.
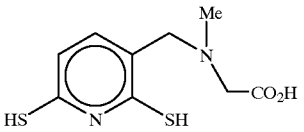
8.
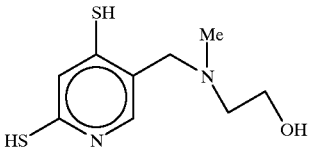
9.
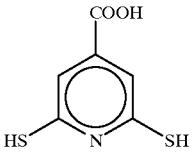
10.
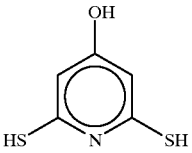
11.
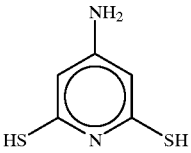
12.
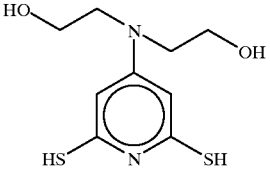
13.
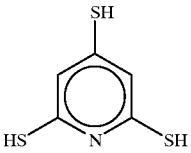
14.
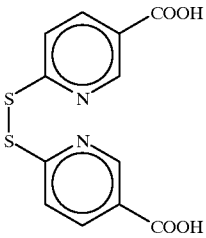
15.
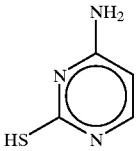
16.
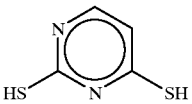
17.
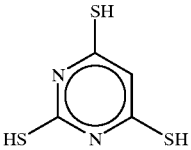
18.
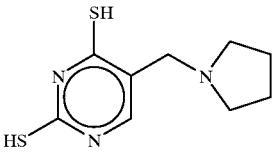
19.
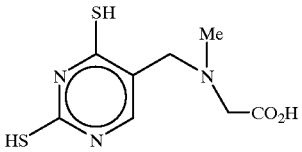
20.
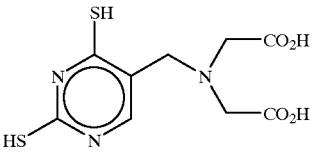
21.
-continued
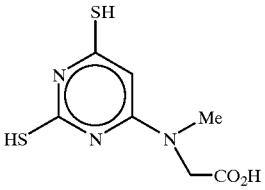
22.
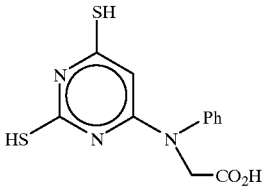
23.
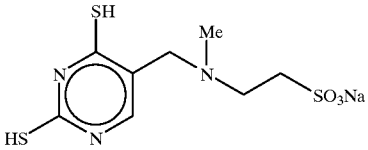
24.
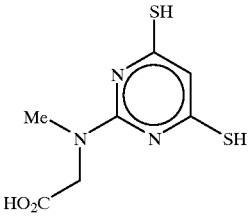
25.
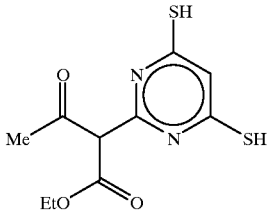
26.
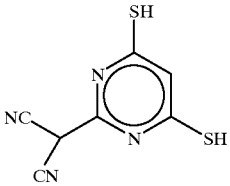
27.
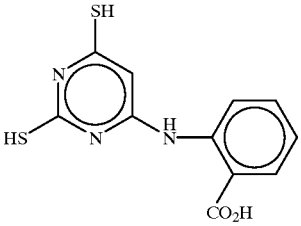
28.
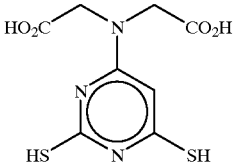
29.
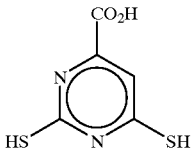
30.
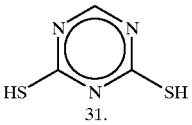
31.
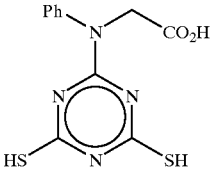
32.

-continued
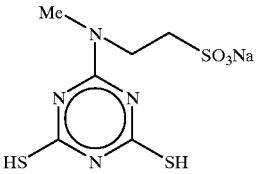
33.
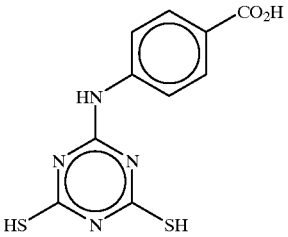
34.
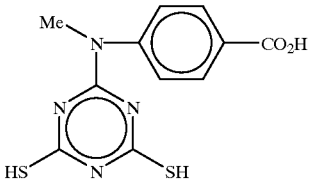
35.
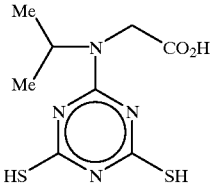
36.
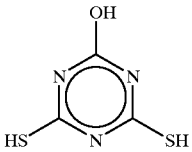
37.
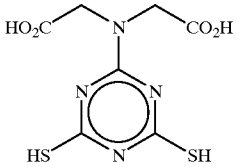
38.
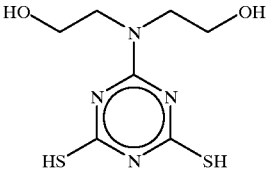
39.
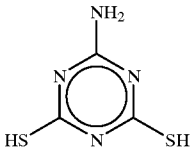
40.
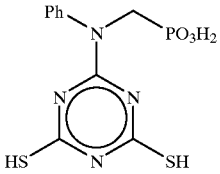
41.
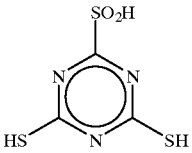
42.
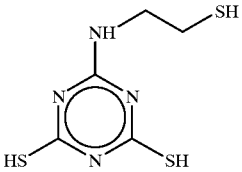
43.
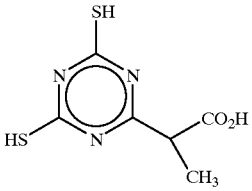
44.
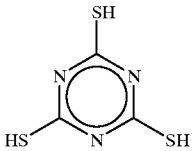
45.
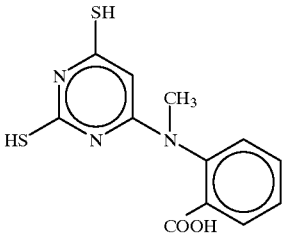
46.
-continued
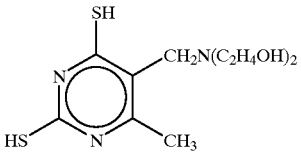
47.
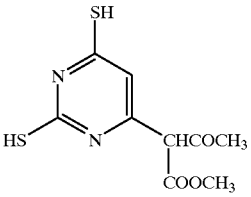
48.
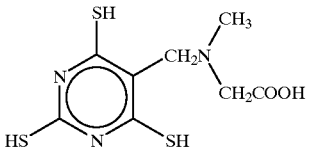
49.
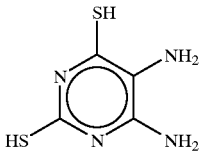
50.
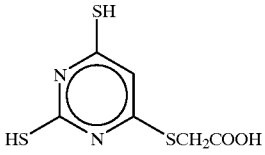
51.
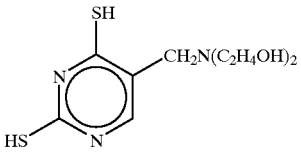
52.
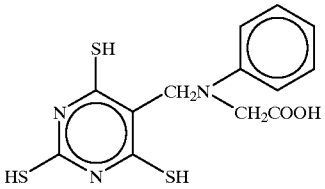
53.
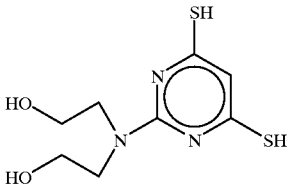
54.
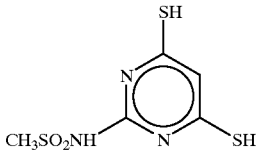
55.

The compound represented by formula (II) is described below.

In formula (II), $R_1$ and $R_2$ each represents a hydroxyl group, an amino group, an acylamino group, an alkylsulfonylamino group, an arylsulfonylamino group, an alkoxycarbonylamino group, a mercapto group or an alkylthio group, and X represents an atomic group necessary to form a 5- or 6-membered ring together with the two vinyl carbon on which $R_1$ and $R_2$ are substituted respectively and with the carbonyl carbon om formula (II).

The compound represented by formula (II) is described in detail below.

In formula (II), $R_1$ and $R_2$ each represents a hydroxyl group, an amino group (including an amino group having, as a substituent, an alkyl group having from 1 to 10 carbon atoms, e.g., methyl, ethyl, n-butyl, hydroxyethyl), an acylamino group (e.g., acetylamino, benzoylamino), an alkylsulfonylamino group (e.g., methanesulfonylamino), an arylsulfonylamino group (benzenesulfonylamino, p-toluenesulfonylamino), an alkoxycarbonylamino group (e.g., methoxycarbonylamino), a mercapto group or an alkylthio group (e.g., methylthio, ethylthio). Preferred examples thereof include a hydroxyl group, an amino group, an alkylsulfonylamino group and an arylsulfonylamino group.

X comprises at least one of a carbon atom, an oxygen atom and a nitrogen atom, and forms a 5- or 6-membered ring together with the two vinyl carbon on which $R_1$ and $R_2$ are substituted and with the carbonyl carbon. Specific examples of X include combinations comprising two or more of —O—, —C—($R_3$)($R_4$)—, —C($R_5$)=, —C(=O)—, —N($R_6$)— and —N=, wherein $R_3$, $R_4$, $R_5$ and $R_6$ each represents a hydrogen atom, an alkyl group having from 1 to 10 carbon atoms which may be substituted with a substituent (including a hydroxyl group, a carboxyl group or a sulfo group can be cited as a substituent), an aryl group having from 6 to 15 carbon atoms which may be substituted with a substituent (including an alkyl group, a halogen atom, a hydroxyl group, a carboxyl group or a sulfo group can be cited as a substituent), a hydroxyl group, or a carboxyl group. Further, the 5- or 6-membered ring may form a saturated or unsaturated condensed ring.

Examples of the 5- or 6-membered rings include a dihydrofuranone ring, a dihydropyrone ring, a pyranone ring, a cyclopentenone ring, a cyclohexenone ring, a pyrrolinone ring, a pyrazolinone ring, a pyridone ring, an azacyclohexenone ring, and an uracil ring, and preferred examples of the 5- or 6-membered rings include a dihydrofuranone ring, a cyclopentenone ring, a cyclohexenone ring, a pyrazolinone ring, an azacyclohexenone ring and an uracil ring.

Specific examples of the compounds represented by formula (II) for use in the present invention are shown below, but the present invention is not limited thereto.

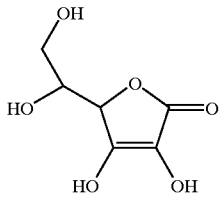

II-1

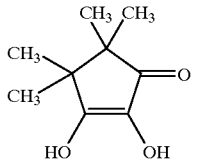

II-2

-continued

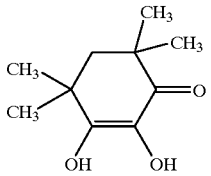

II-2

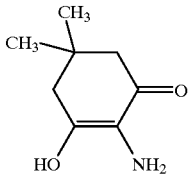

II-4

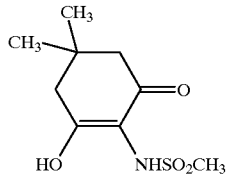

II-5

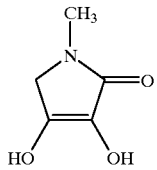

II-6

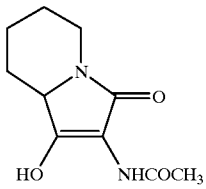

II-7

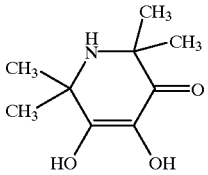

II-8

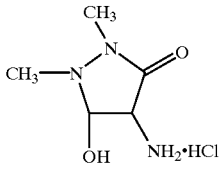

II-9

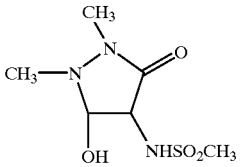

II-10

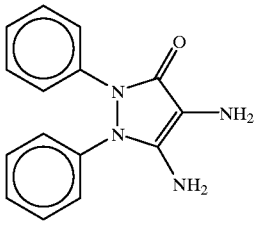

II-11

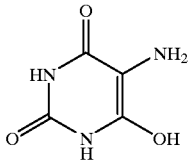

II-12

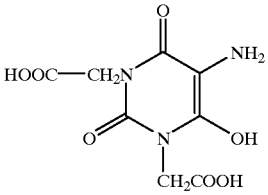

II-13

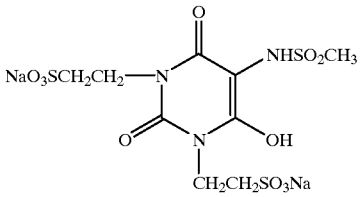

II-14

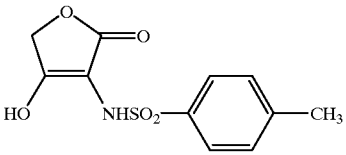

II-15

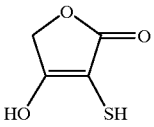

II-16

-continued

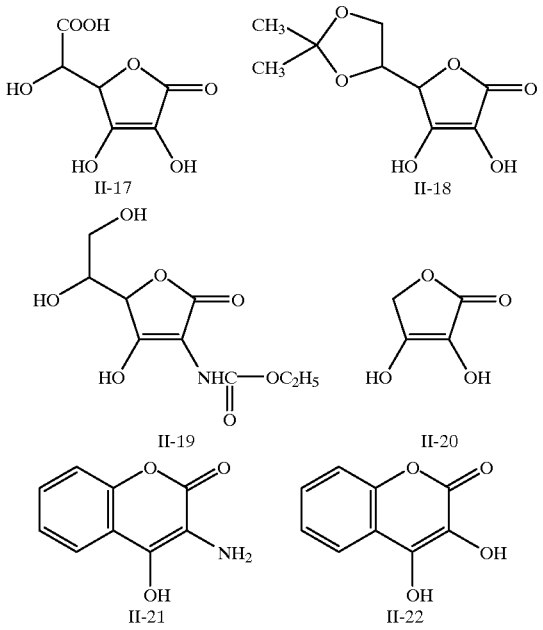

Of these, ascorbic acid or erythorbic acid (stereoisomer) (II-1) is preferred. The compound represented by formula (II) is added in a concentration ratio of the compound represented by formula (II)/the hydroquinone developing agent (the value obtained by dividing the concentration of the compound represented by formula (II) by the concentration of the hydroquinone developing agent) of from 0.03 to 0.12, preferably from 0.03 to 0.10 and particularly preferably from 0.05 to 0.09.

The silver halide in the silver halide emulsion for use in the silver halide photographic material according to the present invention is not particularly limited and any of silver chloride, silver chlorobromide, silver bromide, silver iodochlorobromide or silver iodobromide can be used but is preferably silver chlorobromide or silver iodochlorobromide having a silver chloride content of 50 mol % or more. The form of the silver halide grain may be any of a cubic, tetradecahedral, octahedral, amorphous or plate-like form, but a cubic form is preferred. The average grain size of silver halide grains is preferably from 0.1 $\mu$m to 0.7 $\mu$m, and more preferably from 0.1 $\mu$m to 0.5 $\mu$m. With respect to the grain size distribution, grains having a narrow grain size distribution such that the variation coefficient represented by the equation [(standard deviation of the grain sizes)/(average grain size)]×100 is preferably 15% or less, more preferably 10% or less, are preferred.

The interior and the surface layer of the silver halide grains may comprise a uniform layer or different layers. A localized layer having different halogen composition may be present inside or on the surface of the silver halide grains.

The photographic emulsions for use in the present invention can be prepared according to the methods disclosed in P. Glafkides, *Chimie et Physique Photographique,* Paul Montel (1967), G. F. Duffin, *Photographic Emulsion Chemistry,* The Focal Press (1966), and V. L. Zelikman et al., *Making and Coating Photographic Emulsion,* The Focal Press (1964) and so on.

That is, any process, such as an acid process and a neutral process, can be used. A single jet method, a double jet method, and a combination of them are known as methods for reacting a soluble silver salt with a soluble halide, and any of these methods can be used.

A method in which grains are formed in the presence of excess silver ion (a so-called reverse mixing method) can also be used. A method in which the pAg in the liquid phase in which the silver halide is formed is kept constant, that is, the controlled double jet method, can also be used as one type of the double jet method. In addition, the grain formation is preferably carried out using silver halide solvents such as ammonia, thioether, or tetra-substituted thiourea. More preferred are tetra-substituted thiourea compounds and they are disclosed in JP-A-53-82408 and JP-A-55-77737. Preferred thiourea compounds are tetramethylthiourea and 1,3-dimethyl-2-imidazolidinethione. As the addition amount of a silver halide solvent varies depending on the kind of the compound to be used, the objective grain size, and the halogen composition, from $10^{-5}$ to $10^{-2}$ mol per mol of silver halide is preferred.

Silver halide emulsions with a regular crystal form and a narrow grain size distribution can easily be obtained by the controlled double jet method and the grain formation method using silver halide solvents, which is effective to prepare the silver halide emulsion for use in the present invention.

Moreover, the method in which the addition rates of silver nitrate and alkali halide are varied according to the grain growth rate as disclosed in British Patent 1,535,016, JP-B-48-36890 and JP-B-52-16364, and the method in which the concentrations of aqueous solutions are varied as disclosed in British Patent 4,242,445 and JP-A-55-158124 are preferably and effectively used to rapidly grow grains within the range not exceeding the critical degree of saturation in order to provide uniform grain size.

An emulsion for use in the present invention is preferably monodisperse emulsion having the variation coefficient represented by the equation {(standard deviation of the grain sizes)/(average grain size)}×100 of 20% or less, more preferably 15% or less.

The average grain size of silver halide emulsion grains is preferably 0.5 $\mu$m or less, more preferably from 0.1 to 0.4 $\mu$m.

The silver halide emulsion for use in the present invention may contain metals belonging to Group VIII of the Periodic Table. In particular, it is preferred to contain a rhodium compound, an iridium compound and a ruthenium compound for attaining high contrast and low fog. Further, doping with hexacyanide metal complexes, such as $K_4[Fe(CN)_6]$, $K_4[Ru(CN)_6]$ and $K_3[Cr(CN)_6]$ is advantageous for higher sensitization.

Water-soluble rhodium compounds can be used as a rhodium compound in the present invention, for example, rhodium(III) halide compounds, or rhodium complex salts having halogen, amines, oxalato or aquo as a ligand, such as hexachlororhodium(III) complex salts, pentachloroaquorhodium complex salts, tetrachlorodiaquorhodium complex salts, hexabromorhodium(III) complex salts, hexaamminerhodium(III) complex salts, trioxalatorhodium (III) complex salts and the like. These rhodium compounds are dissolved in water or an appropriate solvent and used. A conventional method such as a method in which an aqueous solution of hydrogen halide (e.g., hydrochloric acid, hydrobromic acid, hydrofluoric acid) or alkali halide (e.g., KCl, NaCl, KBr, NaBr) is added to stabilize the solution of rhodium compound can be used. It is also possible to include and dissolve other silver halide grains which have been previously doped with rhodium during the preparation of silver halide instead of using water-soluble rhodium.

Rhenium, ruthenium, and osmium for use in the present invention are added in the form of water-soluble complex salts as disclosed in JP-A-63-2042, JP-A-1-285941, JP-A-2-20852 and JP-A-2-20855. Particularly preferred compounds are complexes having six ligands represented by the following formula:

$$[ML_6]^{n-}$$

wherein M represents Ru, Re or Os, and n represents 0, 1, 2, 3 or 4.

In this case, counter ions are not important and ammonium or alkali metal ions are used.

Examples of preferred ligands include a halide ligand, a cyanide ligand, a cyanate ligand, a nitrosyil ligand, and a thionitrosyl ligand. Specific examples of complexes for use in the present invention are shown below but the present invention is not limited thereto.

| | | |
|---|---|---|
| $[ReCl_6]^{3-}$ | $[ReBr_6]^{3-}$ | $[ReCl_5(NO)]^{2-}$ |
| $[Re(NS)Br_5]^{2-}$ | $[Re(NO)(CN)_5]^{2-}$ | $[Re(O)_2(CN)_4]^{3-}$ |
| $[RuCl_6]^{3-}$ | $[RuCl_4(H_2O)_2]^{1-}$ | $[RuCl_5(NO)]^{2-}$ |
| $[RuBr_5(NS)]^{2-}$ | $[Ru(CO)_3Cl_3]^{2-}$ | |
| $[Ru(CO)Cl_5]^{2-}$ | $[Ru(CO)Br_5]^{2-}$ | |
| $[OsCl_6]^{3-}$ | $[OsCl_5(NO)]^{2-}$ | $[Os(NO)(CN)_5]^{2-}$ |
| $[Os(NS)Br_5]^{2-}$ | $[Os(CN)_6]^{4-}$ | $[Os(O)_2(CN)_5]^{4-}$ |

The addition amount of these compounds is preferably from $1\times10^{-9}$ mol to $1\times10^{-5}$ mol. and particularly preferably from $1\times10^{-8}$ mol to $1\times10^{-6}$ mol, per mol of silver halide.

Hexachloroiridium, hexabromoiridium, hexaammineiridium, pentachloronitrosyliridium and the like can be used as an iridium compound in the present invention. Hexachlororuthenium and pentachloronitrosylruthenium can be cited as a ruthenium compound for use in the present invention. As an iron compound for use in the present invention, potassium hexacyanoferrate(II) and ferrous thiocyanate can be cited.

The silver halide emulsion for use in the present invention is preferably chemically sensitized. Conventionally known chemical sensitization methods such as sulfur sensitization, selenium sensitization, tellurium sensitization and noble metal sensitization can be used alone or in combination. When sensitization is conducted in combination, a combination of sulfur sensitization and gold sensitization, a combination of sulfur sensitization, selenium sensitization and gold sensitization, and a combination of sulfur sensitization, tellurium sensitization and gold sensitization are preferred, for example.

The sulfur sensitization for use in the present invention is usually carried out by adding a sulfur sensitizer and stirring the emulsion at high temperature of 40° C. or more for a certain period of time. Various known sulfur compounds can be used as a sulfur sensitizer, for example, in addition to sulfur compounds contained in gelatin, various sulfur compounds, e.g., thiosulfates, thioureas, thiazoles, and rhodanines. Preferred sulfur compounds are thiosulfates and thioureas. The addition amount of a sulfur sensitizer is varied in accordance with various conditions such as the pH and temperature during chemical ripening and the grain size of the silver halide grains, but is preferably from $10^{-7}$ to $10^{-2}$ mol and more preferably from $10^{-5}$ to $10^{-3}$ mol. per mol of silver halide.

Various known selenium compounds can be used as a selenium sensitizer in the present invention. The selenium sensitization is usually carried out by adding unstable and/or non-unstable selenium compounds and stirring the emulsion at high temperature of 40° C. or more for a certain period of time. The compounds disclosed in JP-B-44-15748, JP-B-43-13489, JP-A-4-25832, JP-A-4-109240, JP-A-4-324855 can be used as unstable selenium compounds. The compounds represented by formulae (VIII) and (IX) disclosed in JP-A-4-324855 are particularly preferably used.

The tellurium sensitizer for use in the present invention is a compound which forms silver telluride in the surfaces or interiors of silver halide grains which silver telluride is presumed to become sensitization speck. The formation rate of the silver telluride in the silver halide emulsion can be examined according to the method disclosed in JP-A-5-313284.

Specific examples of tellurium sensitizers which can be used in the present invention are those disclosed in the following patents and literature: U.S. Pat. Nos. 1,623,499, 3,320,069, 3,772,031, British Patents 235,211, 1,121,496, 1,295,462, 1,396,696, Canadian Patent 800,958, JP-A-4-20460, JP-A-4-271341, JP-A-4-333043, JP-A-5-303157, *J. Chem. Soc. Chem. Commun.,* 635 (1980), ibid., 1102 (1979), ibid., 645 (1979), *J. Chem. Soc. Perkin. Trans.,* 1, 2191 (1980), S. Patai compiled, *The Chemistry of Organic Selenium and Tellurium Compounds,* Vol. 1 (1986), and ibid., Vol. 2 (1987). The compounds represented by formulae (II), (III) and (IV) disclosed in JP-A-5-313284 are particularly preferred.

The amount of the selenium and tellurium sensitizers to be used in the present invention varies according to the silver halide grains used and the conditions of chemical ripening, but is generally about $10^{-8}$ to $10^{-2}$ mol, preferably about $10^{-7}$ to $10^{-3}$ mol, per mol of silver halide. There is no particular limitation on the conditions of chemical sensitization in the present invention, but pH is from 5 to 8, pAg is from 6 to 11, preferably from 7 to 10, and temperature is from 40 to 95° C., preferably from 45 to 85° C.

The noble metal sensitizers which are used in the present invention include gold, platinum, palladium and iridium, and gold sensitization is particularly preferred. Specific examples of the gold sensitizers for use in the present invention include chloroauric acid, potassium chloroaurate, potassium aurithiocyanate and gold sulfide, and the amount of about $10^{-7}$ to $10^{-2}$ mol per mol of silver halide can be used.

Cadmium salt, sulfite, lead salt and thallium salt may be coexist in the silver halide emulsion for use in the present invention in the process of the formation or physical ripening of silver halide grains.

Reduction sensitization can be used in the present invention. As reduction sensitizers there may be used stannous salt, amines, formamidinesulfinic acid, and silane compounds.

Thiosulfonic acid compounds may be added to the silver halide emulsion of the present invention according to the method disclosed in European Patent 293917.

The silver halide emulsion in the photographic material of the present invention may be one kind, or two or more kinds of silver halide emulsions (for example, those differing in average grain sizes, differing in halogen compositions, differing in crystal habits, or differing in chemical sensitization conditions) may be used in combination. For obtaining high contrast, as disclosed in JP-A-6-324426, it is preferred above all to coat the higher sensitivity emulsion nearer the support as far as possible.

A hydrazine derivative for use in the present invention are described below. The compound represented by formula (I) disclosed in JP-A-7-287355 (corresponding to U.S. Pat. No. 5,496,681) can be used in the present invention, specifically Compounds I-1 to I-53.

The following hydrazine derivatives are also preferably used:

The compound represented by (chem. 1) disclosed in JP-B-6-77138, specifically the compounds on pages 3 and 4 of the same patent; the compound represented by formula (I) disclosed in JP-B-6-93082, specifically Compounds 1 to 38 on pages 8 to 18 of the same patent; the compound represented by any of formula (4), (5) or (6) disclosed in JP-A-6-230497, specifically Compounds 4-1 to 4-10 on pages 25 and 26, Compounds 5-1 to 5-42 on pages 28 to 36, and Compounds 6-1 to 6-7 on pages 39 and 40 of the same patent; the compound represented by formula (1) or (2) disclosed in JP-A-6-289520, specifically Compounds 1-1) to 1-17) and 2-1) on pages 5 to 7 of the same patent; the compound represented by (chem. 2) or (chem. 3) disclosed in JP-A-6-313936, specifically the compounds on pages 6 to 19 of the same patent; the compound represented by (chem. 1) disclosed in JP-A-6-313951, specifically the compounds on pages 3 to 5 of the same patent; the compound represented by formula (I) disclosed in JP-A-7-5610, specifically Compounds I-1 to I-38 on pages 5 to 10 of the same patent; the compound represented by formula (II) disclosed in JP-A-7-77783, specifically Compounds II-1 to II-102 on pages 10 to 27 of the same patent; the compound represented by formula (H) or (Ha) disclosed in JP-A-7-104426, specifically Compounds H-1 to H-44 on pages 8 to 15 of the same patent; the compound having an anionic group or a nonionic group which forms an intramolecular hydrogen bond with the hydrogen atom of the hydrazine in the vicinity of the hydrazine group represented by formula (A), (B), (C), (D), (E) or (F) disclosed in JP-A-9-22082, specifically Compounds N-1 to N-30; and the compound represented by formula (1) disclosed in JP-A-9-22082, specifically Compounds D-1 to D-55.

The hydrazine nucleating agent for use in the present invention can be used in the form of a solution in an appropriate organic solvent miscible with water, such as alcohols (e.g., methanol, ethanol, propanol, fluorinated alcohol), ketones (e.g., acetone, methyl ethyl ketone), dimethylformamide, dimethyl sulfoxide, and methyl cellosolve.

Further, the hydrazine nucleating agent for use in the present invention can also be used in the form of an emulsion dispersion mechanically prepared according to well known emulsifying dispersion methods by dissolving using oils such as dibutyl phthalate, tricresyl phosphate, glyceryl triacetate and diethyl phthalate, or auxiliary solvents such as ethyl acetate and cyclohexanone, or they can be used in the form of a dispersion prepared according to a solid dispersion method in which powders of hydrazine derivatives are dispersed in water using a ball mill, a colloid mill or ultrasonic wave.

The hydrazine nucleating agent for use in the present invention can be added to a silver halide emulsion layer or any other hydrophilic colloid layers on the silver halide emulsion layer side of the support, but is preferably added to the silver halide emulsion layer or the hydrophilic colloid layers adjacent thereto.

The amount of the nucleating agent for use in the present invention is preferably from $1\times10^{-6}$ to $1\times10^{-2}$ mol, more preferably from $1\times10^{-5}$ to $5\times10^{-3}$ mol, and most preferably from $2\times10^{-5}$ to $5\times10^{-3}$ mol, per mol of silver halide.

Amine derivatives, onium salts, disulfide derivatives or hydroxymethyl derivatives can be used as a nucleation accelerating agent in the present invention. Examples thereof are enumerated below: the compound disclosed in lines 2 to 37, page 48 of JP-A-7-77783, specifically Compounds A-1 to A-73, pages 49 to 58 of the same patent; the compound represented by (chem. 21), (chem. 22) or (chem. 23) disclosed in JP-A-7-84331, specifically the compounds on pages 6 to 8 of the same patent; the compound represented by formula (Na) or (Nb) disclosed in JP-A-7-104426, specifically Compounds Na-1 to Na-22 and Nb-1 to Nb-12 on pages 16 to 20 of the same patent; the compound represented by any of formulae (1) to (7) disclosed in JP-A-8-272023, specifically Compounds 1-1 to 1-19, Compounds 2-1 to 2-22, Compounds 3-1 to 3-36, Compounds 4-1 to 4-5, Compounds 5-1 to 5-41, Compounds 6-1 to 6-58, and Compounds 7-1 to 7-38; and the nucleation accelerating agent disclosed in Japanese Patent Application No. 8-70908.

The nucleation accelerating agent for use in the present invention can be used in the form of a solution in an appropriate organic solvent miscible with water, such as alcohols (e.g., methanol, ethanol, propanol, fluorinated alcohol), ketones (e.g., acetone, methyl ethyl ketone), dimethylformamide, dimethyl sulfoxide, and methyl cellosolve.

Further, the nucleation accelerating agent for use in the present invention can also be used in the form of an emulsion dispersion mechanically prepared according to well known emulsifying dispersion methods by dissolving using oils such as dibutyl phthalate, tricresyl phosphate, glyceryl triacetate and diethyl phthalate, or auxiliary solvents such as ethyl acetate and cyclohexanone, or they can be used in the form of a dispersion prepared according to a solid dispersion method in which the powder of a nucleation accelerating agent is dispersed in water using a ball mill, a colloid mill or ultrasonic wave.

The nucleation accelerating agent for use in the present invention can be added to a silver halide emulsion layer or any other hydrophilic colloid layers on the silver halide emulsion layer side of the support, but is preferably added to the silver halide emulsion layer or the hydrophilic colloid layers adjacent thereto.

The amount of the nucleation accelerating agent for use in the present invention is preferably from $1\times10^{-6}$ to $2\times10^{-2}$ mol, more preferably from $1\times10^{-5}$ to $2\times10^{-2}$ mol, and most preferably from $2\times10^{-5}$ to $1\times10^{-2}$ mol. per mol of silver halide.

The light-sensitive silver halide emulsion of the present invention may be spectrally sensitized using a sensitizing dye to a relatively long wavelength blue light, green light, red light and infrared light. Sensitizing dyes such as a cyanine dye, a merocyanine dye, a complex cyanine dye, a complex merocyanine dye, a holopolar cyanine dye, a styryl dye, a hemicyanine dye, an oxonol dye and a hemioxonol dye can be used.

Useful sensitizing dyes for use in the present invention are disclosed in *Research Disclosure, No.* 17643, Item IV-A, p. 23 (December, 1978), ibid., No. 1831, Item X, p. 437 (August, 1979) or the literature cited therein.

In particular, sensitizing dyes having spectral sensitivity suitable for spectral characteristics of light sources of various scanners, image setters and process cameras can be advantageously selected.

The following sensitizing dyes can be advantageously selected, for example, A) for an argon laser light source, Compounds (I)-1 to (I)-8 disclosed in JP-A-60-62247, Compounds I-1 to I-28 in JP-A-2-48653, Compounds I-1 to I-13 in JP-A-4-330434, the compounds disclosed in Example 1 to Example 14 in U.S. Pat. No. 2,161,331, and Compounds 1 to 7 in West German Patent 936,071, B) for a helium-neon laser light source, Compounds I-1 to I-38 disclosed in JP-A-54-18726, Compounds I-1 to I-35 in JP-A-6-75322, and Compounds I-1 to I-34 in JP-A-7-287338, C) for an LED light source, Dyes 1 to 20 disclosed in JP-B-55-39818, Compounds I-1 to I-37 in JP-A-62-284343, and Compounds I-1 to I-34 in JP-A-7-287338, D) for a semiconductor laser light source, Compounds I-1 to I-12 disclosed in JP-A-59-191032, Compounds I-1 to I-22 in JP-A-60-80841, Compounds I-1 to I-29 in JP-A-4-335342, and Compounds I-1 to I-18 in JP-A-59-192242, and E) for tungsten and xenon light sources for a process camera, Compounds (1) to (19) represented by formula (I) disclosed in JP-A-55-45015, Compounds I-1 to I-97 in JP-A-9-160185, and Compounds 4-A to 4-S, Compounds 5-A to 5-Q, and Compounds 6-A to 6-T in JP-A-6-242547.

These sensitizing dyes may be used either alone or in combination of them. A combination of sensitizing dyes is often used, in particular, for the purpose of supersensitization. There may be contained in an emulsion together with sensitizing dyes, a dye having no spectral sensitizing function by itself or a material which does not substantially absorb visible light but shows supersensitization.

A combination of useful sensitizing dyes and dyes showing supersensitization and materials showing supersensitization are disclosed in *Research Disclosure* Vol. 176, No. 17643, page 23, Item IV-J (December, 1978), JP-B-49-25500, JP-B-43-4933, JP-A-59-19032 and JP-A-59-192242.

The sensitizing dyes for use in the present invention may be used in combination of two or more thereof. For the inclusion of the sensitizing dyes in the silver halide emulsion, they may be directly dispersed in the emulsion, or they may be dissolved in water, a single or mixed solvent of methanol, ethanol, propanol, acetone, methyl cellosolve, 2,2,3,3-tetrafluoropropanol, 2,2,2-trifluoroethanol, 3-methoxy-l-propanol, 3-methoxy-l-butanol, 1-methoxy-2-propanol, N,N-dimethylformamide, etc., then added to the emulsion.

In addition, various methods can be used for including sensitizing dyes in the emulsion, for example, a method in which sensitizing dyes are dissolved in a volatile organic solvent, the solution is dispersed in water or hydrophilic colloid and this dispersion is added to the emulsion as disclosed in U.S. Pat. No. 3,469,987, a method in which sensitizing dyes are dissolved in acid and the solution is added to the emulsion, or sensitizing dyes are added to the emulsion as an aqueous solution coexisting with acid or base as disclosed in JP-B-44-23389, JP-B-44-27555 and JP-B-57-22091, a method in which dyes are added to the emulsion as an aqueous solution or colloidal dispersion coexisting with a surfactant as disclosed in U.S. Pat. Nos. 3,822,135 and 4,006,025, a method in which dyes are directly dispersed in a hydrophilic colloid and the dispersion is added to the emulsion as disclosed in JP-A-53-102733 and JP-A-58-105141, or a method in which dyes are dissolved and the solution is added to the emulsion as disclosed in JP-A-51-74624 can be used. Further, ultrasonic waves can be used for dissolution.

The time of the addition of the sensitizing dyes for use in the present invention to the silver halide emulsion of the present invention may be at any stage of the preparation of the emulsion recognized as useful hitherto. For example, they may be added at any stage if it is before coating, i.e., before grain formation stage of silver halide grains or/and before desalting stage, during desalting stage and/or after desalting and before beginning of chemical ripening, as disclosed in U.S. Pat. Nos. 2,735,766, 3,628,960, 4,183,756, 4,225,666, JP-A-58-184142 and JP-A-60-196749, or immediately before or during chemical ripening, after chemical ripening and before coating as disclosed in JP-A-58-113920. Also, as disclosed in U.S. Pat. No. 4,225,666 and JP-A-58-7629, the sensitizing dyes can be used as a single compound alone or in combination with compounds having different structures, and they can be divided and added separately, for example, one part of them is added during grain formation stage and the remaining is added during chemical ripening or after the completion of chemical ripening, otherwise one part is added prior to chemical ripening or during ripening stage and the remaining after completion of chemical ripening. The kinds of compounds added separately and combinations of compounds may be varied.

The addition amount of the sensitizing dyes for use in the present invention is varied in accordance with the shape, size and halide composition of silver halide grains, the method and degree of chemical sensitization, and the kind of antifoggant, but they can be used in an amount of from $4\times10^{-6}$ to $8\times10^{-3}$ mol per mol of silver halide. For example, when the grain size of the silver halide grains is from 0.2 to 1.3 $\mu$m, the addition amount is preferably from $2\times10^{-7}$ to $3.5\times10^{-6}$ mol and more preferably from $6.5\times10^{-7}$ to $2.0\times10^{-6}$ mol per $m^2$ of the surface area of the silver halide grains.

Solid dispersion dyes may be contained in the photographic material produced using the present invention as a filter dye or for the purpose of irradiation prevention or for other various purposes. Dyes preferably used for such purposes are the dye represented by formula (FA), (FA1), (FA2) or (FA3) disclosed in JP-A-9-179243, specifically Compounds F1 to F34. Compounds (II-2) to (II-24) disclosed in JP-A-7-152112, Compounds (III-5) to (III-18) disclosed in JP-A-7-152112, and Compounds (IV-2) to (IV-7) disclosed in JP-A-7-152112 can also be preferably used.

The dyes which can be used in the present invention include, in addition to the above, as solid fine grain dispersion dyes which are decolored at processing, the cyanine dyes, pyrylium dyes and aluminum dyes disclosed in JP-A-3-138640, as dyes which are not decolored at processing, the cyanine dyes having a carboxyl group disclosed in Japanese Patent Application No. 6-279297, the cyanine dyes not having an acidic group disclosed in JP-A-8-245902, the lake type cyanine dyes disclosed in Japanese Patent Application No. 7-135118, the cyanine dyes disclosed in JP-A-1-266536, the holopolar cyanine dyes disclosed in JP-A-3-136038, the pyrylium dyes disclosed in JP-A-62-299959, the polymer type cyanine dyes disclosed in JP-A-7-253639, the solid fine grain dispersions of oxonol dyes disclosed in JP-A-2-282244, the light scattering grains disclosed in JP-A-63-131135, the $Yb^{3+}$ compounds disclosed in JP-A-9-5913, and the ITO powders disclosed in JP-A-7-113072. Further, the dye represented by formula (F1) or (F2) disclosed in JP-A-9-179243, specifically Compounds F35 to F112 can also be used.

Water-soluble dyes may be contained in the photographic material produced using the present invention as a filter dye or for the purpose of irradiation prevention or for other various purposes. Examples of such dyes include an oxonol dye, a benzylidene dye, a merocyanine dye, a cyanine dye, and an azo dye. An oxonol dye, a hemioxonol dye, and a benzylidene dye are useful above all. Specific examples of the dyes which can be used are disclosed in British Patents 584,609, 1,177,429, JP-A-48-85130, JP-A-49-99620, JP-A-49-114420, JP-A-52-20822, JP-A-59-154439, JP-A-59-208548, U.S. Pat. Nos. 2,274,782, 2,533,472, 2,956,879, 3,148,187, 3,177,078, 3,247,127, 3,540,887, 3,575,704, 3,653,905 and 3,718,427.

The silver halide emulsion layers or other hydrophilic colloid layers of the photographic material according to the present invention may contain various surfactants for various purposes such as coating assistance, static charge prevention, improving sliding property, emulsifying dispersion, adhesion prevention, and improving photographic properties (e.g., development acceleration, enhancement of high contrast, sensitization).

Examples thereof include nonionic surfactants such as saponin (steroid series), alkylene oxide derivatives (e.g., polyethylene glycol, a polyethylene glycol/polypropylene glycol condensation product, polyethylene glycol alkyl aryl ethers, polyethylene glycol esters, polyethylene glycol sorbitan esters, polyalkylene glycol alkylamines or amides, polyethylene oxide adducts of silicon), glycidol derivatives (e.g., alkenylsuccinic acid polyglyceride, alkylphenol polyglyceride), fatty acid esters of polyhydric alcohol, and alkyl esters of sucrose; anionic surfactants having an acidic group (e.g., a carboxyl group, a sulfo group, a phospho group, a sulfate group, a phosphate group), such as alkylcarboxylates, alkylsulfonates, alkylbezenesulfonates, alkylnaphtalenesulfonates, alkylsulfates, alkylphosphates, N-acyl-N-alkyltaurines, sulfosuccinates, sulfoalkyl polyoxyethylenealkylphenyl ethers, and polyoxyethylene alkylphosphates; amphoteric surfactants such as amino acids, aminoalkylsulfonic acids, aminoalkylsulfates, aminoalkylphosphates, alkylbetains, and amine oxides; and cationic surfactants such as alkylamine salts, aliphatic or aromatic quaternary ammonium salts, heterocyclic quaternary ammonium salts (e.g., pyridinium and imidazolium), and aliphatic or heterocyclic phosphonium or sulfonium salts.

There is no particular limitation on various additives for use in the present invention and, for example, those described in the following places can preferably be used.

Polyhydroxybenzene compound:

Line 11, right lower column, page 10 to line 5, left lower column, page 12 of JP-A-3-39948, specifically Compounds (III)-1 to (III)-25 disclosed in the same patent.

Compound which has substantially no absorption maximum in visible region:

The compound represented by formula (I) disclosed in JP-A-1-118832, specifically Compounds I-1 to I-26 in the same patent.

Antifoggant:

Line 19, right lower column, page 17 to line 4, right upper column, page 18 of JP-A-2-103536.

Polymer latex:

Line 12, left lower column, page 18 to line 20, left lower column, the same page of JP-A-2-103536, the polymer latex having an active methylene group represented by formula (I) disclosed in Japanese Patent Application No. 8-13592, specifically Compounds I-1 to I-16, the polymer latex having a core/shell structure disclosed in JP-A-9-179228, specifically Compounds P-1 to P-55, and the acidic polymer latex disclosed in line 1, left column, page 14 to line 30, right column, the same page of JP-A-7-104413, specifically Compounds II-1) to II-9) on page 15 of the same patent.

Matting agent, sliding agent and plasticizer:

Line 15, left upper column, page 19 to line 15, right upper column, the same page of JP-A-2-103536.

Hardening agent:

Line 5, right upper column, page 18 to line 17, right upper column, the same page of JP-A-2-103536.

Compound having acidic group:

Line 6, right lower column, page 18 to the first line, left upper column, page 19 of JP-A-2-103536.

Conductive material:

Line 13, left lower column, page 2 to line 7, right upper column, page 3 of JP-A-2-18542, specifically metal oxides in line 2, right lower column, page 2 to line 10, right lower column of the same page, and conductive high polymer Compounds P-1 to P-7 disclosed in the same patent.

Redox compound:

The redox compound capable of releasing a development inhibitor by oxidation disclosed in JP-A-5-274816, preferably the redox compound represented by any of formulae (R-1), (R-2) and (R-3), specifically Compounds R-1 to R-68 in the same patent.

Binder:

From first line to line 20, right lower column, page 3 of JP-A-2-18542.

As the support which can be used in the present invention, for example, baryta paper, polyethylene-laminated paper, polypropylene synthetic paper, glass sheet, cellulose acetate, cellulose nitrate, and polyester films, e.g., polyethylene terephthalate can be cited. These supports are respectively arbitrarily selected according to the use purpose of the silver halide photographic material.

Processing chemicals such as a developing solution and a fixing solution and processing methods according to the present invention are described below, but the present invention is not limited to the following description and specific examples.

Any conventional methods and conventional development processing solutions can be used in the development processing of the present invention.

A developing agent for use in the developing solution (hereinafter, a developing starting solution and a developing replenisher are referred to as a developing solution put together) of the present invention is not particularly limited, as long as it contains a hydroquinone compound. The developing solution preferably contains a hydroquinonemonosulfonate. Further, from the point of developing capability, combination of hydroquinones with 1-phenyl-3-pyrazolidones, or combination of hydroquinones with p-aminophenols is preferred.

The hydroquinone developing agent for use in the present invention includes hydroquinone, chlorohydroquinone, isopropylhydroquinone and methylhydroquinone, and hydroquinone is particularly preferred.

1-Phenyl-3-pyrazolidones or derivatives thereof as a developing agent for use in the present invention include 1-phenyl-3-pyrazolidone, 1-phenyl-4,4-dimethyl-3-pyrazolidone, and 1-phenyl-4-methyl-4-hydroxymethyl-3-pyrazolidone.

p-Aminophenol developing agents for use in the present invention include N-methyl-p-aminophenol, p-aminophenol, N-(β-hydroxyphenyl)-p-aminophenol, N-(4-hydroxyphenyl)glycine, o-methoxy-p-(N,N-dimethylamino)phenol, and o-methoxy-p-(N-methylamino)phenol, and N-methyl-p-aminophenol and the aminophenols disclosed in Japanese Patent Application Nos. 8-70908 and 8-70935 are preferred.

The hydroquinone developing agent is, in general, preferably used in an amount of from 0.05 to 0.8 mol/liter. When hydroquinones are used in combination with l-phenyl-3-pyrazolidones or p-aminophenols, the amount of the former is from 0.05 to 0.6 mol/liter, preferably from 0.15 to 0.5 mol/liter, and the latter is 0.06 mol/liter or less, preferably from 0.03 to 0.003 mol/liter.

A developing solution for processing a photographic material in the present invention can contain additives generally used (e.g., a developing agent, an alkali agent, a pH buffer, a preservative, a chelating agent, etc.). Specific examples of them are shown below but the present invention is not limited to these.

A buffer which is used in a developing solution for development processing a photographic material in the present invention includes carbonate, the boric acids disclosed in JP-A-62-186259, saccharides (e.g., saccharose) disclosed in JP-A-60-93433, oximes (e.g., acetoxime), phenols (e.g., 5-sulfosalicylic acid) and tertiary phosphate (e.g., sodium salt, potassium salt), and carbonate and boric acid are preferably used. The use amount of a buffer, in particular, carbonate, is preferably 0.1 mol/liter or more, particularly preferably from 0.2 to 1.5 mol/liter.

Examples of the preservatives which can be used in the developing solution for use in the present invention include sodium sulfite, potassium sulfite, lithium sulfite, ammonium sulfite, sodium bisulfite, potassium metabisulfite, and sodium formaldehyde bisulfite. Preferred addition amount of the sulfite preservative is 0.2 mol/liter or more, particularly preferably 0.3 mol/liter or more, but as too much an amount causes silver stain of the developing solution, the upper limit is preferably 1.2 mol/liter, particularly preferably from 0.35 to 0.7 mol/liter.

Additives which can be used in the present invention include, in addition to the above compounds, a development inhibitor such as sodium bromide and potassium bromide; an organic solvent such as ethylene glycol, diethylene glycol, triethylene glycol, and dimethylformamide; a development accelerator such as alkanolamine, e.g., diethanolamine and triethanolamine, imidazole or derivatives thereof; and a physical development unevenness inhibitor such as a heterocyclic mercapto compound (e.g., sodium 3-(5-mercaptotetrazol-1-yl)benzene sulfonate, 1-phenyl-5-mercaptotetrazole) and the compounds disclosed in JP-A-62-212651.

Further, mercapto based compounds, indazole based compounds, benzotriazole based compounds and benzimidazole based compounds can be used as an antifoggant or a black pepper inhibitor. Specific examples include 5-nitroindazole, 5-p-nitrobenzoylaminoindazole, 1-methyl-5-nitroindazole, 6-nitroindazole, 3-methyl-5-nitroindazole, 5-nitrobenzimidazole, 2-isopropyl-5-nitrobenzimidazole, 5-nitrobenzotriazole, sodium 4-[(2-mercapto-1,3,4-thiadiazol-2-yl)thio]-butanesulfonate, 5-amino-1,3,4-thiadiazole-2-thiol, benzotriazole, 5-methylbenzotriazole, and 2-mercaptobenzotriazole. The addition amount of these compounds is, in general, from 0.01 to 10 mmol, more preferably from 0.1 to 2 mmol, per liter of the developing solution.

Further, various kinds of organic and inorganic chelating agents can be used alone or in combination in the developing solution of the present invention.

Examples of inorganic chelating agents include sodium tetrapolyphosphate and sodium hexametaphosphate.

On the other hand, as an organic chelating agent, organic carboxylic acid, aminopolycarboxylic acid, organic phosphonic acid, aminophosphonic acid, and organic phosphonocarboxylic acid can be primarily used.

Examples of the organic carboxylic acids include acrylic acid, oxalic acid, malonic acid, succinic acid, glutaric acid, gluconic acid, adipic acid, pimelic acid, acielaidic acid, sebacic acid, nonanedicarboxylic acid, decanedicarboxylic acid, undecanedicarboxylic acid, maleic acid, itaconic acid, malic acid, citric acid, and tartaric acid.

Examples of the aminopolycarboxylic acids include iminodiacetic acid, nitrilotriacetic acid, nitrilotripropionic acid, ethylenediaminemonohydroxyethyltriacetic acid, ethylenediaminetetraacetic acid, glycol ether tetraacetic acid, 1,2-diaminopropanetetraacetic acid, diethylenetriaminepentaacetic acid, triethylenetetraminehexaacetic acid, 1,3-diamino-2-propanoltetraacetic acid, glycol ether diaminetetraacetic acid, and the compounds disclosed in JP-A-52-25632, JP-A-55-67747, JP-A-57-102624, and JP-B-53-40900.

Examples of the organic phosphonic acids include the hydroxyalkylidene-diphosphonic acids disclosed in U.S. Pat. Nos. 3,214,454, 3,794,591 and West German Patent Publication No. 2,227,639, and the compounds disclosed in *Research Disclosure, Vol.* 181, Item 18170 (May, 1979).

Examples of the aminophosphonic acids include aminotris(methylenephosphonic acid), ethylenediaminetetramethylenephosphonic acid, aminotrimethylenephosphonic acid, and the compounds disclosed in *Research Disclosure,* No. 18170, JP-A-57-208554, JP-A-54-61125, JP-A-55-29883 and JP-A-56-97347.

Examples of the organic phosphonocarboxylic acids include the compounds disclosed in JP-A-52-102726, JP-A-53-42730, JP-A-54-121127, JP-A-55-4024, JP-A-55-4025, JP-A-55 -126241, JP-A-55-65955, JP-A-55-65956 and *Research Disclosure,* No. 18170.

The organic and/or inorganic chelating agent are(is) not limited to the above-described compounds. The chelating agent may be used in the form of an alkali metal salt or an ammonium salt. The addition amount of the chelating agent is preferably from $1\times10^{-4}$ to $1\times10^{-1}$ mol, more preferably from $1\times10^{-3}$ to $1\times10^{-2}$ mol, per liter of the developing solution.

Further, the developing solution can contain the following compounds as a silver stain preventing agent, in addition to the compounds disclosed in JP-A-56-24347, JP-B-56-46585, JP-B-62-2849 and JP-A-4-362942, pyrazine having one or more mercapto groups (e.g., 2-mercaptopyrazine, 2,6-dimercaptopyrazine, 2,3-dimercaptopyrazine, 2,3,5-trimercaptopyrazine), pyridazine having one or more mercapto groups (e.g., 3-mercaptopyridazine, 3,4-dimercaptopyridazine, 3,5-dimercaptopyridazine, 3,4,6-trimercaptopyridazine), the compounds disclosed in JP-A-7-175177, and the polyoxyalkylphosphonate disclosed in U.S. Pat. No. 5,457,011. These silver stain preventing agents can be used alone or in combination of two or more, and they are used in an amount of preferably from 0.05 to 10 mmol, more preferably from 0.1 to 5 mmol, per liter of the developing solution.

Further, the compounds disclosed in JP-A-61-267759 can be used as a dissolution aid.

Further, if necessary, the developing solution may contain a toning agent, a surfactant, a defoaming agent and a hardening agent.

The pH of the developing solution is from 9.0 to 11.0, and preferably from 9.5 to 11.0. As an alkali agent which is used for adjusting pH, water-soluble inorganic alkali metal salts generally used (e.g., sodium hydroxide, potassium hydroxide, sodium carbonate, potassium carbonate) can be used.

As the cation in a developing solution, a potassium ion does not inhibit development so much as a sodium ion does, and provides less fringes around the blackened part compared with a sodium ion. Further, when a developing solution is preserved as a concentrated solution, a potassium salt has, in general, higher solubility and preferred. However, since a potassium ion in a fixing solution inhibits fixation in the same degree as a silver ion does, if the potassium ion concentration in a developing solution is high, the potassium ion concentration in a fixing solution becomes high by the developing solution carried over with a photographic material, which is not preferred. Accordingly, the molar ratio of the potassium ion to the sodium ion in a developing solution is preferably between 20/80 and 80/20. The ratio of the potassium ion to the sodium ion in a developing solution can be arbitrarily adjusted within the above range by the counter cation of a pH buffer, a pH adjustor, a preservative, a chelating agent, etc.

The replenishing rate of a developing solution is preferably 330 ml or less per $m^2$ of the photographic material, more preferably from 30 to 330 ml, and most preferably from 120 to 330 ml, per $m^2$ of the photographic material. The composition and/or the concentration of a developing replenisher may be the same as or different from those of a developing starter.

Ammonium thiosulfate, sodium thiosulfate and sodium ammonium thiosulfate can be used as the fixing agent of fixation processing chemicals in the present invention. The amount used of the fixing agent can be varied arbitrarily and is generally from about 0.7 to about 3.0 mol/liter.

The fixing solution according to the present invention may contain a water-soluble aluminum salt and a water-soluble chromium salt having a function as a hardening agent. Preferred compounds are water-soluble aluminum salts, e.g., aluminum chloride, aluminum sulfate, potassium alum, aluminum ammonium sulfate, aluminum nitrate and aluminum lactate. They are preferably contained in an amount of from 0.01 to 0.15 mol/liter in terms of an aluminum ion concentration in the working solution.

When the fixing solution is preserved as a concentrated solution or a solid agent, it may comprise a plurality of parts with a hardening agent being a separate part or it may comprise one reagent type including all the components.

The fixation processing chemicals can contain, if desired, a preservative (e.g., sulfite, bisulfite, and metabisulfite, in an amount of 0.015 mol/liter or more, preferably from 0.02 mol/liter to 0.3 mol/liter), a pH buffer (e.g., acetic acid, sodium acetate, sodium carbonate, sodium hydrogencarbonate, phosphoric acid, succinic acid, and adipic acid, in an amount of from 0.1 mol/liter to 1 mol/liter, preferably from 0.2 mol/liter to 0.7 mol/liter), and a compound having stabilizing capability of aluminum and water softening capability (e.g., gluconic acid, iminodiacetic acid, 5-sulfosalicylic acid, glucoheptanoic acid, malic acid, tartaric acid, citric acid, oxalic acid, maleic acid, glycolic acid, benzoic acid, salicylic acid, Tiron, ascorbic acid, glutaric acid, aspartic acid, glycine, cysteine, ethylenediaminetetraacetic acid, nitrilotriacetic acid, derivatives thereof and salts thereof, saccharides and boric acid in an amount of from 0.001 mol/liter to 0.5 mol/liter, preferably from 0.005 mol/liter to 0.3 mol/liter).

In addition, the fixation processing chemicals can also contain the compounds disclosed in JP-A-62-78551, a pH adjustor (e.g., sodium hydroxide, ammonia, sulfuric acid), a surfactant, a wetting agent, and a fixation accelerator. Specific examples of surfactants include an anionic surfactant (e.g., a sulfated product, a sulfonated product), a polyethylene based surfactant, and the amphoteric surfactants disclosed in JP-A-57-6840, and known defoaming agents can also be used. Specific examples of wetting agents include alkanolamine and alkylene glycol. Specific examples of fixing accelerators include the alkyl- and aryl-substituted thiosulfonic acid and the salts thereof disclosed in JP-A-6-308681, the thiourea derivatives disclosed in JP-B-45-35754, JP-B-58-122535 and JP-B-58-122536, an alcohol having a triple bond in the molecule, the thioether compounds disclosed in U.S. Pat. No. 4,126,459, the mercapto compounds disclosed in JP-A-1-4739, JP-A-1-159645 and JP-A-3-101728, the mesoionic compounds disclosed in JP-A-4-170539, and thiocyanate.

The pH of the fixing solution for use in the present invention is generally 4.0 or more and preferably from 4.5 to 6.0. The pH of the fixing solution rises according to processing by the mixture of a developing solution. In such a case the pH of a hardening fixing solution is 6.0 or less, preferably 5.7 or less, and that of a non-hardening fixing solution is 7.0 or less, preferably 6.7 or less.

The replenishing rate of the fixing solution is generally 500 ml or less, preferably 390 ml or less, more preferably from 80 to 330 ml, per $m^2$ of the photographic material. The compositions and/or the concentration of a fixing replenisher may be the same as or different from those of a fixing starter.

Silver recovery from a fixing solution can be carried out according to known fixing solution reclaiming methods, such as electrolytic silver recovery, and the regenerated solution after the silver recovery can be used in the present invention. As such a reclaiming device, Reclaim R-60 produced by Fuji Hunt Co., Ltd. can be cited.

Further, the removal of dyes and the like using an adsorptive filter such as an activated carbon is also preferred.

A photographic material is subjected to washing or stabilization processing after being development processed and fixing processed (hereinafter washing includes stabilization processing and the solution used therefor is called water or washing water unless otherwise indicated). The water which is used for washing may be any of city water, ion exchange water, distilled water, and stabilizing solution. The replenishing rate thereof is, in general, from about 8 liters to about 17 liters per $m^2$ of the photographic material, but washing can be carried out with the less replenishing rate. In particular, with a replenishing rate of 3 liters or less (including zero, i.e., washing in a reservoir), not only water saving processing can be carried out but also piping for installation of an automatic processor is not required. When washing is carried out with a reduced amount of water, it is preferred to use a washing tank equipped with the squeegee roller or the crossover roller disclosed in JP-A-63-18350 and JP-A-62-287252. The addition of various kinds of oxidizing agents (e.g., ozone, hydrogen peroxide, sodium hypochlorite, activated halogen, chlorine dioxide, sodium carbonate hydrogen peroxide) and the provision of filters for filtration may be combined to reduce load in environmental pollution which becomes a problem when washing is carried out with a small amount of water and to prevent generation of scale.

As a means of reducing the replenishing rate of the washing water, a multistage countercurrent system (e.g., two stages or three stages) has been known for long, and the replenishing rate of the washing water in this system is preferably from 50 to 200 ml per $m^2$ of the photographic material. This is also effective in an independent multistage system (a method which is not a countercurrent system and fresh solution is replenished separately to multistage washing tanks).

Further, a means of preventing generation of scale may be included in washing process according to the present invention. A means of preventing generation of scale is not particularly limited and known methods can be used, such as a method of adding antifungal agents (a scale preventive), a method by electroconduction, a method of irradiating ultraviolet ray or infrared ray and far infrared ray, a method of making the magnetic field, a method by ultrasonic wave processing, a method by heating, and a method of emptying tanks when they are not used. These scale preventing means may be conducted in proportion to the progress of the processing of photographic materials, may be conducted at regular intervals irrespective of usage conditions, or may be conducted only during the time when processing is not conducted, for example, during night. In addition, washing water previously provided with such a means may be replenished. It is also preferred to conduct different scale preventing means for every given period of time for inhibiting the proliferation of resisting fungi.

An antifungal agent is not particularly limited and any known antifungal agents can be used. Examples thereof include, for example, a chelating agent such as glutaraldehyde and aminopolycarboxylic acid, cationic surfactants, and mercaptopyridine oxide (e.g., 2-mercaptopyridine-N-oxide), in addition to the above-described oxidants, and they can be used alone or in combination of two or more.

Methods by electroconduction disclosed in JP-A-3-224685, JP-A-3-224687, JP-A-4-16280 and JP-A-4-18980 can be used in the present invention.

Moreover, known water-soluble surfactants or defoaming agents may be contained in a washing water for preventing generation of irregulars due to foaming and transfer of stains. In addition, the dye-adsorbents disclosed in JP-A-63-163456 may be included in a washing tank to inhibit contamination by dyes dissolved out from photographic materials.

All or a part of the overflow from the washing process can be utilized by mixture in the processing solution having fixing ability as disclosed in JP-A-60-235133. It is also preferred from the environmental protection for a washing solution to be processed by various processes before draining, for example, biochemical oxygen demand (BOD), chemical oxygen demand (COD), iodine consumption, etc., are reduced by a microorganism process (e.g., processes using sulfur oxide fungus and activated sludge, a process using a filter of a porous carrier, such as activated carbon or ceramic, carrying microorganisms) and an oxidation process by electroconduction and oxidants, or silver is precipitated by adding a compound which forms a hardly soluble silver complex such as trimercaptotriazine and filtrated using a filter of a polymer having affinity with silver to reduce the silver concentration in water drained.

Also, when a photographic material is subjected to stabilization processing after washing processing, a bath containing the compounds disclosed in JP-A-2-201357, JP-A-2-132435, JP-A-1-102553 and JP-A-46-44446 may be used as a final bath. This stabilizing bath may also contain, if desired, ammonium compounds, metal compounds such as Bi and Al, brightening agents, various kinds of chelating agents, film pH adjustors, hardening agents, sterilizers, antifungal agents, alkanolamines, and surfactants.

Additives such as antifungal agents and stabilizing agents which are added to a washing bath and a stabilizing bath can also be solid agents as the above-described developing and fixing processing chemicals.

Waste solutions of the developing solution, fixing solution, washing water and stabilizing solution for use in the present invention are preferably subjected to incineration disposal. It is also possible to discard these waste solutions as concentrated solutions made using concentrators as disclosed in JP-B-7-83667 and U.S. Pat. No. 5,439,560, or as solids.

In the case when the replenishing rate is reduced, it is preferred to prevent evaporation and air oxidation of the solution by minimizing the open area of the processing tank. A roller transporting type automatic processor is disclosed in U.S. Pat. Nos. 3,025,779 and 3,545,971 and referred to as merely a roller transporting type processor in the specification of the present invention. A roller transporting type processor comprises four steps of development, fixation, washing and drying and, although the method of the present invention does not exclude other steps (e.g., stopping step), it is most preferred to follow this four step system. Further, a rinsing bath may be provided between development and fixation and/or between fixation and washing.

Development processing according to the present invention is preferably carried out by development processing of dry to dry of from 25 to 160 seconds, with development and fixing time being 40 seconds or less, preferably from 6 to 35 seconds, the temperature of each processing solution being from 25 to 50° C., preferably from 30 to 40° C. The temperature and the washing time are preferably from 0 to 50° C. and 40 seconds or less, respectively. According to the method of the present invention, photographic materials having been developed, fixed and washed may be dried after the water content is squeezed out of the materials, that is, through squeegee rollers. The drying step is carried out at a temperature of from about 40 to about 100° C. and the time therefor can vary properly depending upon the surroundings. Drying methods are not particularly limited and any known methods can be used, such as a warm air drying method, the heated roller drying method and the far infrared ray drying method disclosed in JP-A-4-15534, JP-A-5-2256 and JP-A-5-289294 and a plurality of methods can be used in combination.

When the developing and fixing processing chemicals of the present invention are solutions, they are preferably preserved in the packaging materials of low oxygen permeation as disclosed in JP-A-61-73147. Further, when the are concentrated solutions, they are diluted with water for use to a predetermined concentration in a ratio of from 0.2 to 3 parts of water to one part of the concentrated solutions.

Whether the developing processing chemicals and fixing processing chemicals of the present invention are solids or solutions, the same effects can be obtained. Solid processing chemicals are described below.

Solid chemicals for use in the present invention may be made into known shapes such as powders, granular powders, granules, lumps, tablets, compactors, briquettes, sheets, cracked products, bars or paste. These solid chemicals may be covered with water-soluble coating agents or coating films to separate components which react with each other on contact, or they may comprise a multilayer structure to separate components which react with each other, or both types may be used in combination.

Known materials can be used for coating, but polyvinyl pyrrolidone, polyethylene glycol, polystyrene sulfonic acid and vinyl compounds are preferably used. In addition, gelatin, pectin, polyacrylic acid, polyvinyl alcohol, vinyl acetate copolymer, polyethylene oxide, sodium carboxymethyl cellulose, hydroxypropyl cellulose, methyl cellulose, ethyl cellulose, alginic acid, chitaric acid gum, gum arabic, tragacanth gum, karaya gum, carrageenan, methyl vinyl ether, maleic anhydride copolymer, polyoxyethylene alkyl ether such as polyoxyethylene stearyl ether, and polyoxyethylene ethyl ether, polyoxyethylene alkylphenol ether such as polyoxyethylene octylphenol ether, and polyoxyethylene nonylphenol ether, and the water-soluble binders disclosed in JP-A-4-85535 can be used alone or in combination of two or more. These compounds can also be used as an auxiliary granulating agent.

When a multilayer structure is used, components which do not react with each other on contact may be sandwiched with components which react with each other and made into tablets and briquettes, or components of known shapes may be made to similar layer structure and packaged. Methods therefor are disclosed in JP-A-61-259921, JP-A-4-15641, JP-A-4-16841, JP-A-4-32837, JP-A-4-78848 and JP-A-5-93991.

The bulk density of the solid processing chemicals is preferably from 0.5 to 6.0 g/cm$^3$, in particular, the bulk density of a tablet is preferably from 1.0 to 5.0 g/cm$^3$ and that of a granule is preferably from 0.5 to 1.5 g/cm$^3$.

Solid processing chemicals according to the present invention can be produced using any known method, for example, with respect to packaging methods, JP-A-61-259921, JP-A-4-16841, and JP-A-4-78848 can be referred to. Further, the methods disclosed in the following patents can be used as the method for preparing solid processing chemicals in the present invention: JP-A-4-85533, JP-A-4-85534, JP-A-4-85535, JP-A-5-134362, JP-A-5-197070, JP-A-5-204098, JP-A-5-224361, JP-A-6-138604, JP-A-6-138605 and JP-A-8-286329.

Specifically, a rolling granulating method, an extrusion granulating method, a compression granulating method, a cracking granulating method, a stirring granulating method, a spray drying method, a dissolution coagulation method, a briquetting method, and a roller compacting method can be used.

The shape and the grain size of granulated chemicals suitable in the present invention are different in accordance with the desired properties and, taking into consideration of the desired solubility in photographic processing in general and the residual amount of powder in the waste packaging material after preparation of the solution or the resistance to breakdown of granulated chemicals due to the vibration during transportation, the grain diameter of a granule in terms of sphere is from 0.5 to 50 mm or so, preferably from 1 to 15 mm or so and the shape is a cylindrical, spherical, cubic or rectangular shape, more preferably a spherical or cylindrical shape.

A product produced by a roller compacting method may be cracked or the diameter may be made 2 mm to 1 cm by further passing through a sieve.

The shape and the grain size of a briquette and a tablet are also different in accordance with the desired properties, but are preferably from 2 mm to 5 cm or so and a cylindrical, spherical, cubic or rectangular shape, more preferably a spherical or cylindrical shape. When it is desired to increase the solubility, a sheet-like shape having a thinner thickness, one the thickness of the central part of which is made further thinner, and a hollow doughnut type are also useful. On the contrary, the grain size and the thickness may be made larger for lowering the solubility, which can be adjusted arbitrarily. Further, the state of the surface (smooth, porous, etc.) of the solid chemicals may be changed for controlling the solubility. Moreover, it is possible to provide different solubilities to a plurality of granulated products, and it is also possible for materials having different solubilities to take various shapes to coincide with solubilities thereof. Multilayer granulated products having different compositions between the inside and the surface can also be used.

Packaging materials of solid processing chemicals preferably have low oxygen and water permeability and bag-like, cylindrical and box-like shapes can be used. Packaging materials of foldable shapes are preferred for saving storage space of waste materials as disclosed in JP-A-6-242585 to JP-A-6-242588, JP-A-6-247432, JP-A-6-247448, JP-A-6-301189, JP-A-7-5664, and JP-A-7-5666 to JP-A-7-5669. Takeout ports of processing chemicals of these packaging materials may be provided with a screw cap, a pull-top or an aluminum seal, or packaging materials may be heat-sealed, or other known types may be used, and there are no particular limitations. Waste packaging materials are preferred to be recycled for reclaiming or reused from the environmental protection.

Methods of dissolution and replenishment of the solid processing chemicals according to the present invention are not particularly limited and known methods can be used. Examples of these known methods include a method in which a certain amount of processing chemicals are dissolved and replenished by a dissolving device having a stirring function, a method in which processing chemicals are dissolved by a dissolving device having a dissolving zone and a zone where a finished solution is stocked and the solution is replenished from the stock zone as disclosed in JP-A-9-80718, and as disclosed in JP-A-5-119454, JP-A-6-19102 and JP-A-7-261357, a method in which processing chemicals are fed to a circulating system of an automatic processor and dissolved and replenished, and a method in which processing chemicals are fed to a dissolving tank equipped in an automatic processor in proportion to the progress of the processing of photographic materials. In addition to the above methods, any of known methods can be used. Processing chemicals may be opened and fed by hands, or automatic opening and automatic charge may be conducted by the dissolving device provided with opening mechanism as disclosed in JP-A-9-138495, or by an automatic processor. The latter is preferred from the work environment. Specifically, there are methods of pushing through, unsealing, cutting off, and bursting the takeout port of a package, and the methods disclosed in JP-A-6-19102 and JP-A-6-95331.

The present invention will be described in greater detail below with reference to the following examples, but the invention should not be construed as being limited thereto.

EXAMPLE 1

| Preparation of Emulsion A | |
|---|---|
| Solution 1 | |
| Water | 1 liter |
| Gelatin | 20 g |
| Sodium Chloride | 3.0 g |
| 1,3-Dimethylimidazolidine-2-thione | 20 mg |
| Sodium Benzenethiosulfonate | 8 mg |
| Solution 2 | |
| Water | 400 ml |
| Silver Nitrate | 100 g |
| Solution 3 | |
| Water | 400 ml |
| Sodium Chloride | 27.1 g |
| Potassium Bromide | 21.0 g |
| Ammonium Hexachloroiridate (III) (0.001% aqueous solution) | 20 ml |
| Potassium Hexachlororhodate (III) (0.001% aqueous solution) | 6 ml |

Solution 2 and Solution 3 were simultaneously added to Solution 1 maintained at 42° C. and to have a pH of 4.5 over a period of 15 minutes with stirring, and nucleous grains were formed. Subsequently, Solution 4 and Solution 5 shown below were added over a period of 15 minutes. Further, 0.15 g of potassium iodide was added thereto and grain formation was terminated.

| | |
|---|---|
| Solution 4 | |
| Water | 400 ml |
| Silver Nitrate | 100 g |
| Solution 5 | |
| Water | 400 ml |
| Sodium Chloride | 27.1 g |

-continued

| Preparation of Emulsion A | |
|---|---|
| Potassium Bromide | 21.0 g |
| Potassium Hexacyanoferrate (II) (0.1% aqueous solution) | 10 ml |

The mixture was then washed according to an ordinary flocculation method and 40 g of gelatin was added.

The pH and pAg were adjusted to 5.7 and 7.5, respectively, and 1.0 mg of sodium thiosulfate, 4.0 mg of chloroauric acid, 1.5 mg of triphenylphosphine selenide, 8 mg of sodium benzenethiosulfonate, and 2 mg of sodium benzenethiosulfinate were added and optimal chemical sensitization was carried out at 55° C.

Further, 100 mg of 4-hydroxy-6-methyl-1,3,3a,7-tetraazaindene as a stabilizer and phenoxyethanol as a preservative were added to finally obtain cubic silver chloroiodobromide Emulsion A having a silver chloride content of 70 mol % and an average grain size of 0.25 μm.

Preparation of Coated Sample

To Emulsion A were added Sensitizing Dye (1) in an amount of $3.8\times10^{-4}$ mol/mol Ag and spectral sensitization was conducted. Further, KBr in an amount of $3.4\times10^{-4}$ mol/mol Ag, Compound (1) in an amount of $3.2\times10^{-4}$ mol/mol Ag, Compound (2) in an amount of $8.0\times10^{-4}$ mol/mol Ag, hydroquinone in an amount of $1.2\times10^{-2}$ mol/mol Ag, citric acid in an amount of $3.0\times10^{-3}$ mol/mol Ag, Compound (3) in an amount of $1.0\times10^{-4}$ mol/mol Ag, Compound (4) in an amount of $6.0\times10^{-4}$ mol/mol Ag, 35 wt %, based on gelatin, of polyethyl acrylate latex, 20 wt %, based on gelatin, of colloidal silica having a particle size of 10 mμ, and 4 wt %, based on gelatin, of Compound (5) were added thereto. The thus-obtained coating solution was coated on a polyester support to provide a coated silver weight of 3.7 g/m$^2$ and a coated gelatin weight of 1.6 g/m$^2$. An upper protective layer and a lower protective layer each having the composition shown below were coated on this support and a UL layer having the composition shown below was coated beneath the lower protective layer.

| Upper Protective Layer | |
|---|---|
| Gelatin | 0.3 g/m$^2$ |
| Silica Matting Agent (average particle size: 3.5 μm) | 25 mg/m$^2$ |
| Compound (6) (gelatin dispersion) | 20 mg/m$^2$ |
| Colloidal Silica (particle size: 10 to 20 μm) | 30 mg/m$^2$ |
| Compound (7) | 5 mg/m$^2$ |
| Sodium Dodecylbenzenesulfonate | 20 mg/m$^2$ |
| Compound (8) | 20 mg/m$^2$ |
| Lower Protective Layer | |
| Gelatin | 0.5 g/m$^2$ |
| Compound (9) | 15 mg/m$^2$ |
| 1,5-Dihydroxy-2-benzaldoxime | 10 mg/m$^2$ |
| Polyethyl Acrylate Latex | 150 mg/m$^2$ |
| UL Layer | |
| Gelatin | 0.5 g/m$^2$ |
| Polyethyl Acrylate Latex | 150 mg/m$^2$ |
| Compound (5) | 40 mg/m$^2$ |
| Compound (10) | 10 mg/m$^2$ |

The support of the sample which was used in the present invention had the
backing layer and the conductive layer having the following compositions.

| Backing Layer | |
|---|---|
| Gelatin | 3.3 g/m$^2$ |
| Sodium Dodecylbenzenesulfonate | 80 mg/m$^2$ |
| Compound (11) | 40 mg/m$^2$ |
| Compound (12) | 20 mg/m$^2$ |
| Compound (13) | 90 mg/m$^2$ |
| 1,3-Divinylsulfonyl-2-propanol | 60 mg/m$^2$ |
| Polymethyl Methacrylate Fine Grains (average particle size: 6.5 μm) | 30 mg/m$^2$ |
| Compound (5) | 120 mg/m$^2$ |
| Conductive Layer | |
| Gelatin | 0.1 g/m$^2$ |
| Sodium Dodecylbenzenesulfonate | 20 mg/m$^2$ |
| $SnO_2$/Sb (9/1 by weight, average grain size: 0.25 μm) | 200 mg/m$^2$ |

Sensitizing Dye (I)

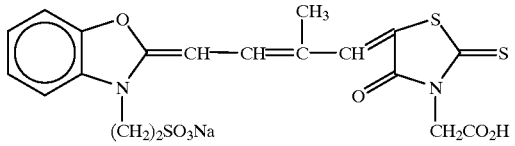

Compound (1)

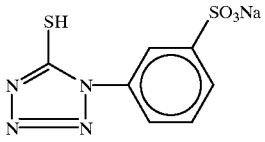

-continued
Compound (2)
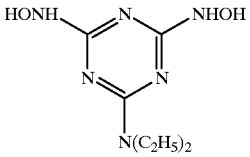
Compound (3)
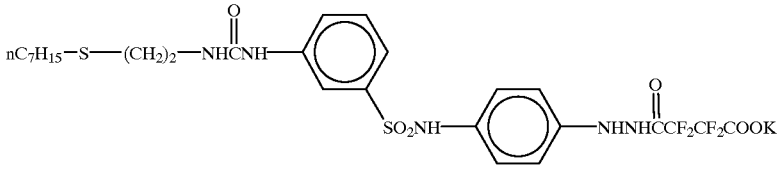
Compound (4)
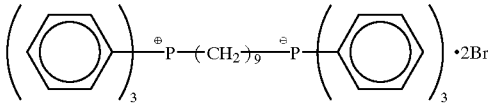
Compound (5)
A 3/1 mixture of n = 2/n = 3
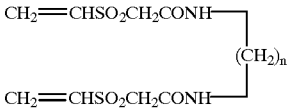
Compound (6)
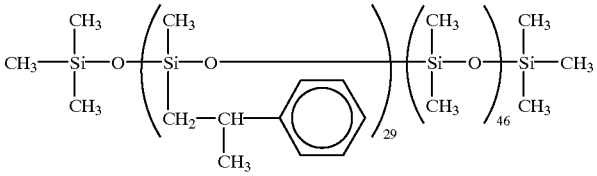
Compound (7)
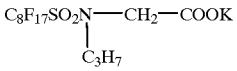
Compound (8)
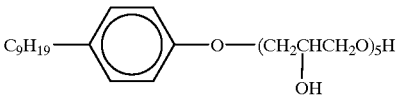
Compound (9)
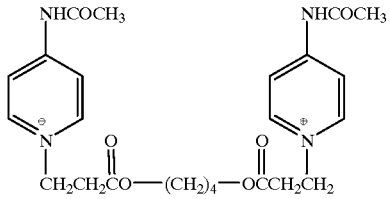
Compound (10)
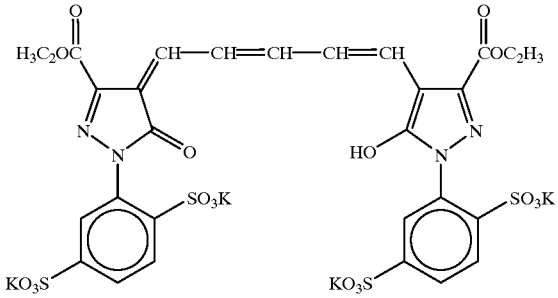

-continued

Compound (11)

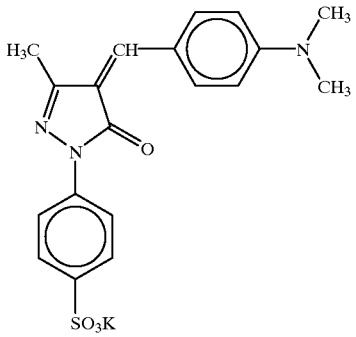

Compound (12)

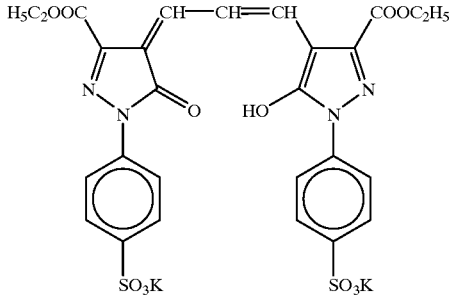

Compound (13)

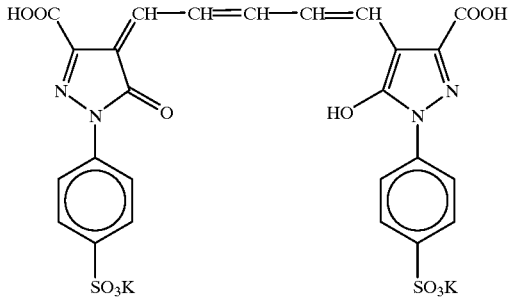

The composition per liter of the concentrated developing solution is shown below.

| | |
|---|---|
| Potassium Hydroxide | 105.0 g |
| Diethylenetriaminepentaacetic Acid | 6.0 g |
| Potassium Carbonate | 120.0 g |
| Sodium Metabisulfate | 120.0 g |
| Potassium Bromide | 9.0 g |
| Hydroquinone | 75.0 g |
| 5-Methylbenzenetriazole | 0.24 g |
| 4-Hydroxymethyl-4-methyl-1-phenyl-3-pyrazolidone | 1.35 g |
| Diethylene Glycol | 60.0 g |
| pH | 10.7 |

One part of the above concentrated solution is diluted with 2 parts of water for use. The pH of the working solution is 10.5.

Developing solutions for test shown in Table 1 were prepared using this concentrated developing solution as a base.

TABLE 1

| | Compound of Formula (I) | | Compound of Formula (II) | |
|---|---|---|---|---|
| No. of Developing Solution | Name of Compound | Addition Amount (g/liter) | Name of Compound | Addition Amount (g/liter) |
| 1 (Comparison) | — | — | — | — |
| 2 (Comparison) | — | — | II-1 | 2.5 |
| 3 (Comparison) | Comparative Compound A | 0.29 | II-1 | 2.5 |
| 4 (Comparison) | Comparative Compound B | 0.18 | II-1 | 2.5 |
| 5 (Invention) | I-20 | 0.24 | II-1 | 2.5 |
| 6 (Invention) | I-6 | 0.16 | II-3 | 3.0 |
| 7 (Invention) | I-22 | 0.23 | II-8 | 3.0 |
| 8 (Invention) | I-39 | 0.25 | II-18 | 2.5 |
| 9 (Invention) | I-32 | 0.29 | II-1 | 2.5 |
| 10 | I-46 | 0.29 | II-1 | 2.5 |

TABLE 1-continued

| No. of Developing Solution | Compound of Formula (I) Name of Compound | Compound of Formula (I) Addition Amount (g/liter) | Compound of Formula (II) Name of Compound | Compound of Formula (II) Addition Amount (g/liter) |
|---|---|---|---|---|
| (Invention) 11 | I-20 | 0.24 | II-1 | 0.5 |
| (Comparison) 12 | I-20 | 0.24 | II-1 | 6.0 |
| (Comparison) | | | | |

Comparative Compound A

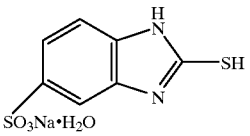

Comparative Compound B

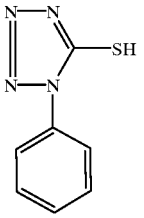

The composition per liter of the concentrated fixing solution is shown below.

| | |
|---|---|
| Ammonium Thiosulfate | 360.0 g |
| Disodium Ethylenediaminetetraacetate Dihydrate | 0.09 g |
| Sodium Thiosulfate Pentahydrate | 33.0 g |
| Sodium Metasulfite | 57.0 g |
| Sodium Hydroxide | 37.2 g |
| Acetic Acid (100%) | 90.0 g |
| Tartaric Acid | 8.7 g |
| Sodium Gluconate | 5.1 g |
| Aluminum Sulfate | 25.2 g |
| pH | 4.85 |

One part of the above concentrated solution is diluted with 2 parts of water for use. The pH of the working solution is 4.8.

Each of the above produced samples was exposed with xenon flash light of emission time of $10^{-6}$ sec. through an interference filter which had a peak at 633 nm and through a step wedge, and subjected to development processing at 35° C. for 30 sec. with the above described developing solution, then fixation, washing and drying processing.

Development was conducted using automatic processor AP-560, produced by Fuji Photo Film Co., Ltd.

Subsequently, running test was conducted using the above samples.

Running conditions were such that 30 sheets of 50% blackened large size films (50.8×61.0 cm) (five sheets of ten sheets had been exposed to light) were processed per one day, and running processing was continued for six days and stopped for one day, this procedure was repeated 3 times, then photographic properties and silver stain were evaluated.

Replenishing rat e in development was described in Table 2 and that in fixation was 100 ml per one sheet of a large size film.

Herein, the reciprocal of the exposure amount required to give a density of 1.5 was taken as the sensitivity and this is shown as a relative sensitivity, with t he sensitivity when processed with a fresh solution of Developing Solution No. 1 being a control. Relative sensitivity values of from 93 to 107 are acceptable.

The gradient of the straight line joining the points of fog+density 0.3 and fog+density 3.0 of the characteristic curve was taken as the index (γ value) (gradation) showing the contrast of images. That is, γ=(3.0−0.3)/[log(exposure amount giving a density of 3.0)−log(exposure amount giving a density of 0.3)]. The larger the gamma value, the higher is the contrast. Dmax was expressed by the density at the point of exposure higher by logE 0.4 than the exposure amount required to give a density of 1.5 and the value of 4.5 or more is requisite as Dmax.

Silver stain was evaluated visually in five grades. The five grades of evaluation represent from "5" no generation of silver stain at all on the film, the developing tank and the rollers to "1" generation of silver stain all over the film and extreme silver stain on the developing tank and the rollers. "4" is no generation on the film but a little generation on the developing tank, the rollers and at allowable level for practical use, and "3" or less is at practically problematic or impracticable level.

The results of photographic properties and silver stain by running test are shown in Table 2 below.

TABLE 2

| Experiment No. | Developing Solution | Replenishing Rate ($ml/m^2$) | Photographic Properties | Running Properties Fresh Solution | Running Properties last | Silver Stain |
|---|---|---|---|---|---|---|
| 1 | 1 | 325 | Dmax | 5.62 | 5.65 | 2 |
| Comparison | | | Gradation | 24.0 | 25.3 | |
| | | | Sensitivity | 100 | 115 | |
| 2 | 2 | 325 | Dmax | 5.64 | 5.60 | 2 |
| Comparison | | | Gradation | 24.1 | 23.1 | |
| | | | Sensitivity | 101 | 98 | |
| 3 | 3 | 325 | Dmax | 5.40 | 5.43 | 3 |
| Comparison | | | Gradation | 22.3 | 21.1 | |
| | | | Sensitivity | 95 | 94 | |
| 4 | 3 | 484 | Dmax | 5.40 | 5.44 | 4 |
| Comparison | | | Gradation | 22.3 | 22.5 | |
| | | | Sensitivity | 95 | 95 | |

TABLE 2-continued

| Experiment No. | Developing Solution | Replenishing Rate (ml/m$^2$) | Running Properties: Photographic Properties | Fresh Solution | last | Silver Stain |
|---|---|---|---|---|---|---|
| 5 Comparison | 4 | 325 | Dmax | 4.85 | 4.32 | 4 |
| | | | Gradation | 16 | 14 | |
| | | | Sensitivity | 80 | 75 | |
| 6 Invention | 5 | 325 | Dmax | 5.60 | 5.62 | 5 |
| | | | Gradation | 24.2 | 23.4 | |
| | | | Sensitivity | 100 | 98 | |
| 7 Invention | 6 | 325 | Dmax | 5.48 | 5.31 | 4 |
| | | | Gradation | 21.0 | 20.3 | |
| | | | Sensitivity | 99 | 99 | |
| 8 Invention | 7 | 325 | Dmax | 5.57 | 5.40 | 4 |
| | | | Gradation | 24.3 | 24.0 | |
| | | | Sensitivity | 98 | 99 | |
| 9 Invention | 8 | 325 | Dmax | 5.46 | 5.33 | 4 |
| | | | Gradation | 23.3 | 20.9 | |
| | | | Sensitivity | 101 | 100 | |
| 10 Invention | 9 | 325 | Dmax | 5.55 | 5.31 | 5 |
| | | | Gradation | 23.9 | 21.5 | |
| | | | Sensitivity | 99 | 95 | |
| 11 Invention | 10 | 325 | Dmax | 5.33 | 5.33 | 4 |
| | | | Gradation | 22.2 | 22.5 | |
| | | | Sensitivity | 98 | 96 | |
| 12 Comparison | 11 | 325 | Dmax | 5.60 | 5.51 | 5 |
| | | | Gradation | 24.2 | 24.8 | |
| | | | Sensitivity | 100 | 110 | |
| 13 Comparison | 12 | 325 | Dmax | 5.50 | 5.02 | 5 |
| | | | Gradation | 24.2 | 20.0 | |
| | | | Sensitivity | 100 | 89 | |

It is apparently seen from the results in Table 2 that Experiment Nos. 1 to 4 which do not use the compound according to the present invention (formula (I)) generated conspicuous silver stain due to running processing and silver stain could not be improved without increasing replenishing rate. Experiment No. 5 was good in silver stain but photographic properties considerably deteriorated. It was found from Experiment Nos. 12 and 13, in which the amounts of the compound of the present invention (formula (II)) were varied, that silver stain was good but the sensitivity fluctuation due to running processing was large. In the experiment of the samples containing the compounds of the present invention (formulae (I) and (II)), both photographic properties and silver stain showed excellent results.

EXAMPLE 2

Preparation of Emulsion

Emulsion A:

To a 1.5% aqueous solution of gelatin, maintained at 40° C. and pH 2.0, containing sodium chloride, $3\times10^{-5}$ mol per mol of silver of sodium benzenethiosulfonate and $5\times10^{-3}$ mol per mol of silver of 4-hydroxy-6-methyl-1,3,3a,7-tetraazaindene, an aqueous solution of silver nitrate and an aqueous solution of sodium chloride containing $5\times10^{-5}$ mol per mol of silver of $K_2[Ru(NO)Cl_5]$ were simultaneously added by a double jet method over 3 minutes and 30 seconds and half of the silver amount of the final grains were added while maintaining the potential at 95 mV, and core grains having a grain size of 0.12 pm were prepared.

Subsequently, an aqueous solution of silver nitrate and an aqueous solution of sodium chloride containing $5\times10^{-5}$ mol per mol of silver of $K_2[Ru(NO)Cl_5]$ were added over 7 minutes in the same manner as above and silver chloride cubic grains having the average grain size of 0.16 $\mu$m were prepared (variation coefficient: 12%).

The mixture was then washed according to an ordinary flocculation method, soluble salt was removed, and gelatin was added. Compound-F and phenoxyethanol as antiseptics were added each in an amount of 60 mg per mol of silver, and pH and pAg were adjusted to 5.1 and 7.5, respectively. Further, sodium thiosulfate in an amount of $1\times10^{-5}$ mol per mol of silver, a selenium sensitizer SE-4 in an amount of $1\times10^{-5}$ mol and chloroauric acid in an amount of $4\times10^{-5}$ mol each per mol of silver were added and the mixture was heated at 60° C. for 60 minutes and chemical sensitization was carried out. Then, $2\times10^{-3}$ mol per mol of silver of 4-hydroxy-6-methyl-1,3,3a,7-tetraazaindene as a stabilizer was added and pH was adjusted to 5.7. (Finally obtained grains had pH 5.7, pAg 7.5, Ru=$5\times10^{-5}$ mol/Ag mol.)

Emulsion B:

Emulsion B was prepared in the same manner as the preparation of Emulsion A except that the addition amount of $K_2[Ru(NO)Cl_5]$ was $3\times10^{-5}$ mol/Ag mol.

Preparation of Coating Solution for Emulsion Layer and Coating Thereof:

The following compounds were added to Emulsion A and Emulsion B and each silver halide emulsion layer was coated on the following support having an undercoat layer in such a manner that Emulsion A became an upper emulsion layer and Emulsion B a lower emulsion layer. The coating weights of gelatin and silver were an upper emulsion layer/a lower emulsion layer of 0.59/0.30 g/m$^2$ and 1.8/0.9 g/m$^2$, respectively.

Coating Solution for Emulsion Layer (The coating weight of each component is the total of upper and lower emulsion layers.)

| | |
|---|---|
| 1-Phenyl-5-mercaptotetrazole | 10 mg/m$^2$ |
| Sodium 3-(5-mercaptotetrazole)benzenesulfonate | 11 mg/m$^2$ |
| Sodium N-oleyl-N-methyltaurine | 19 mg/m$^2$ |
| Hydrazine Compound | 20 mg/m$^2$ |

-continued

| | |
|---|---|
| Compound-A | 20 mg/m$^2$ |
| Compound-$B_1$ | 13 mg/m$^2$ |
| Compound-$B_2$ | 15 mg/m$^2$ |
| Compound-C | 70 mg/m$^2$ |
| Ascorbic Acid | 1 mg/m$^2$ |
| Acetic Acid | an amount to provide film pH of 5.2 to 6.0 |
| Compound D | 1 g/m$^2$ |
| Liboran-1400 (manufactured by Lion Yushi) | 50 mg/m$^2$ |
| Compound E (hardening agent) | an amount to provide swelling factor in water of 80% |
| pH (adjusted to 5.6) | |

Lower and upper emulsion protective layers were coated as upper layers on the above emulsion layer.

Preparation of Coating Solution for Lower Emulsion Protective Layer and Coating Thereof The following compounds were added to an aqueous solution of gelatin and the lower emulsion protective layer was coated on the above emulsion layer in a gelatin coating weight of 0.8 g/m$^2$.

| | |
|---|---|
| Gelatin ($Ca^{++}$ content: 2,700 ppm) | 0.8 g/m$^2$ |
| Compound F | 1 mg/m$^2$ |
| 1,5-Dihydroxy-2-benzaldoxime | 14 mg/m$^2$ |
| $C_2H_5SO_2SNa$ | 3 mg/m$^2$ |
| Compound H | 20 mg/m$^2$ |
| Compound C | 3 mg/m$^2$ |
| Compound I | 200 mg/m$^2$ |
| Sodium p-Dodecylbenzenesulfonate | 7 mg/m$^2$ |
| Compound G | 20 mg/m$^2$ |

Preparation of Coating Solution for Upper Emulsion Protective Layer and Coating Thereof The following compounds were added to an aqueous solution of gelatin and the upper emulsion protective layer was coated on the above emulsion layer in a gelatin coating weight of 0.4 g/m$^2$.

| | |
|---|---|
| Gelatin ($Ca^{++}$ content: 2,700 ppm) | 0.45 g/m$^2$ |
| Amorphous Silica Matting Agent (average particle size: 4.4 $\mu$m) | 40 mg/m$^2$ |
| Amorphous Silica Matting Agent (average particle size: 3.6 $\mu$m) | 10 mg/m$^2$ |
| Compound F | 1 mg/m$^2$ |
| Compound C | 8 mg/m$^2$ |
| Solid Dispersion Dye-$G_1$ | 68 mg/m$^2$ |
| Solid Dispersion Dye-$G_2$ | 80 mg/m$^2$ |
| Liquid Paraffin | 21 mg/m$^2$ |
| Potassium N-Perfluorooctanesulfonyl-N-propylglycine | 5 mg/m$^2$ |
| Sodium p-Dodecylbenzenesulfonate | 29 mg/m$^2$ |

The following conductive layer and backing layer were coated on the opposite side of the support simultaneously.

Preparation of Coating Solution for Conductive Layer and Coating Thereof

The following compounds were added to an aqueous solution of gelatin and the conductive layer was coated on the above support in a gelatin coating weight of 0.06 g/m$^2$.

| | |
|---|---|
| $SnO_2$/Sb (9/1 by weight, average particle size: 0.25 $\mu$m) | 186 mg/m$^2$ |
| Gelatin ($Ca^{++}$ content: 2,700 ppm) | 0.06 g/m$^2$ |
| Sodium p-Dodecylbenzenesulfonate | 13 mg/m$^2$ |
| Sodium Dihexyl-$\alpha$-sulfosuccinato | 12 mg/m$^2$ |
| Compound C | 12 mg/m$^2$ |
| Compound F | 1 mg/m$^2$ |

Preparation of Coating Solution for Backing Layer and Coating Thereof

The following compounds were added to an aqueous solution of gelatin and the backing layer was coated on the above support in a gelatin coating weight of 1.94 g/M$^2$.

| | |
|---|---|
| Gelatin ($Ca^{++}$ content: 30 ppm) | 1.94 g/m$^2$ |
| Polymethyl Methacrylate Fine Particles (average particle size: 4.7 $\mu$m) | 7 mg/m$^2$ |
| Compound J | 233 mg/m$^2$ |
| Compound K | 21 mg/m$^2$ |
| Compound G | 146 mg/m$^2$ |
| Compound F | 3 mg/m$^2$ |
| Sodium p-Dodecylbenzenesulfonate | 68 mg/m$^2$ |
| Sodium Dihexyl-$\alpha$-sulfosuccinato | 21 mg/m$^2$ |
| $C_8F_{17}SO_3Li$ | 4 mg/m$^2$ |
| Potassium N-Perfluorooctanesulfonyl-N-propylglycine | 6 mg/m$^2$ |
| Sodium Sulfate | 177 mg/m$^2$ |
| Compound E (hardening agent) | an amount to provide swelling factor in water of 90% |

Support and Undercoat Layer

On both sides of a biaxially stretched polyethylene terephthalate support having a thickness of 100 $\mu$m, the first and second undercoat layers having the following compositions were coated.

First Undercoat Layer

| | |
|---|---|
| Core/Shell Type Vinylidene Chloride Copolymer (1) | 15 g |
| 2,4-Dichloro-6-hydroxy-s-triazine | 0.25 g |
| Polystyrene Fine Particles (average particle size: 3 $\mu$m) | 0.05 g |
| Compound M | 0.20 g |
| Colloidal Silica (Snowtex ZL (particle size: 70 to 100 $\mu$m) (produced by Nissan Chemical Industries, Ltd.) | 0.12 g |
| Water to make | 100 g |

The coating solution whose pH was adjusted with 10 wt % of KOH to 6 was coated on the support at the drying temperature of 180° C. for 2 minutes so that the dried film thickness reached 0.9 $\mu$m.

Second Undercoat Layer

| | |
|---|---|
| Gelatin | 1 g |
| Methyl Cellulose | 0.05 g |
| Compound-L | 0.02 g |
| $C_{12}H_{25}O(CH_2CH_2O)_{10}H$ | 0.03 g |
| Compound-F | $3.5 \times 10^{-3}$ g |
| Acetic Acid | 0.2 g |

The coating solution was coated on the support at the drying temperature of 170° C. for 2 minutes so that the dried film thickness reached 0.1 $\mu$m.

SE-4
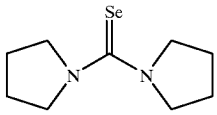
Hydrazine Compound
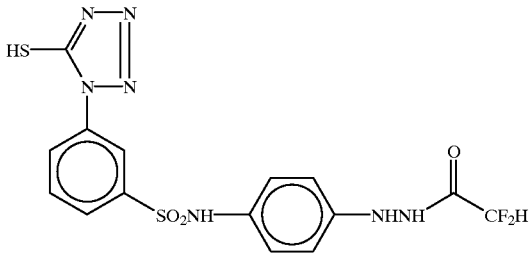
Compound-$B_1$
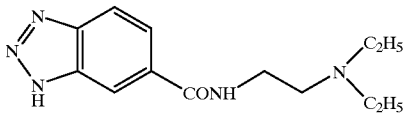
Compound-$B_2$
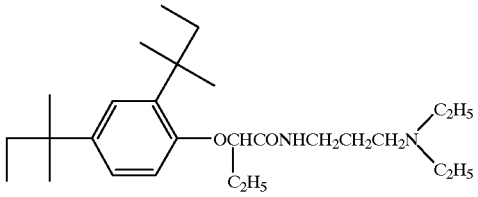
Compound-C
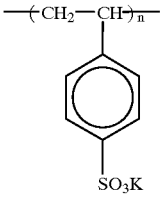
Compound-D
Core/shell - 50/50
<Core part: St/Bu = 37/63>
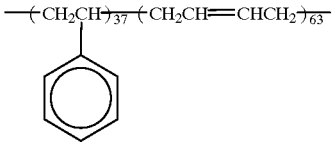
<Shell part: St/AAEMA = 84/16>
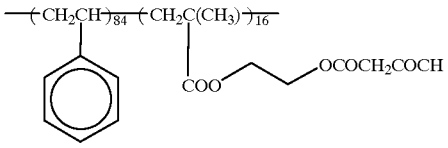
Compound-A
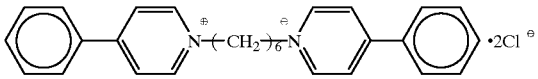
-continued
Compound-E
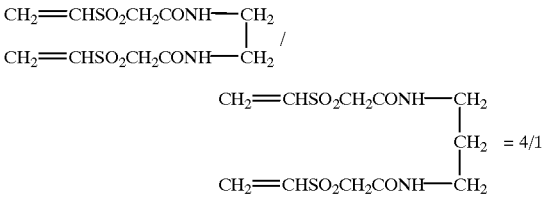
Compound-F
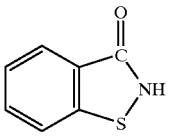
Solid Dispersion Dye-$G_1$
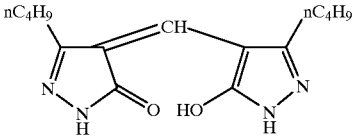
Solid Dispersion Dye-$G_2$
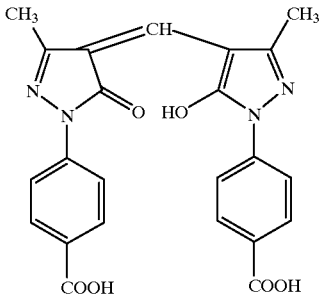
Compound-G
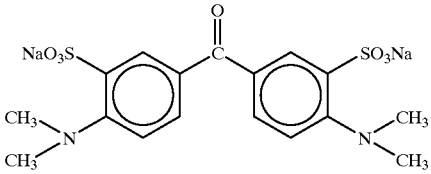
Compound-H
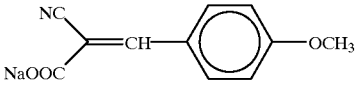
Compound-I
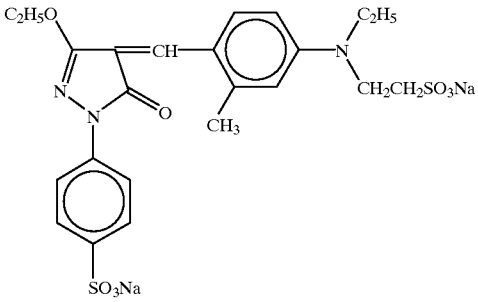

-continued

Compound-J

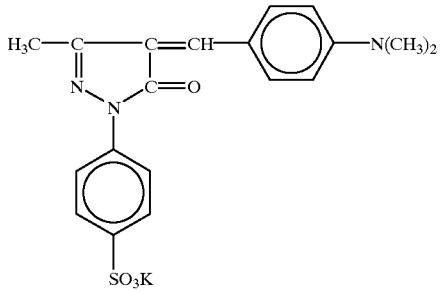

Compound-K

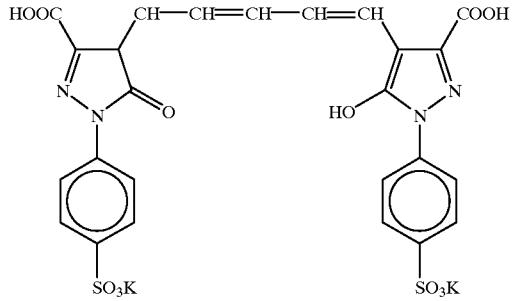

Compound-L

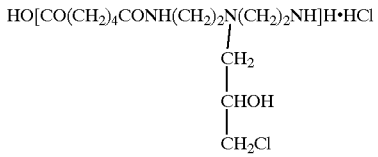

Core-shell Type Vinylidene Chloride Copolymer (1)

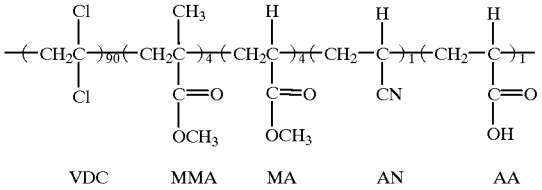

VDC MMA MA AN AA

Core: VDC/MMA/MA (80 wt%)
Shell: VDC/AN/AA (20 wt%)
Average particle size: 70 nm Compound-M

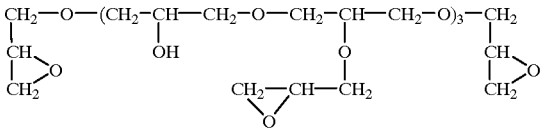

Coating Method

The emulsion layer, the lower emulsion protective layer and the upper emulsion protective layer were multilayer coated simultaneously on the above prepared support having the undercoat layer in this order from the support side. Coating was conducted by adding a hardening solution by a slide hopper system while maintaining the temperature at 35° C. After passing a cold air setting zone (5° C.), the conductive layer and the backing layer were multilayer coated simultaneously on the opposite side of the emulsion layer side in this order from the support side also by adding a hardening solution by a slide hopper system then passed the cold air setting zone (5° C.). At the point when the material passed each setting zone, each coating solution showed sufficient setting capability. Subsequently, both sides of the material were dried simultaneously in a drying zone according to the following conditions. After coating of the back face until winding up, the material was transported so as not to touch anything, e.g., rollers and others. The coating rate at this time was 120 m/min.

Drying Condition

After passing the cold air setting zone, the material was dried with a dry air of 30° C. until the weight ratio of water/gelatin became 800%, then dried with a 35° C. 30% dry air until 800% of the weight ratio became 200%, the material was continued to be exposed to the air, and 30 seconds after the time when the surface of the material reached 34° C. (took it for the finish of drying), the material was further dried with a 48° C. 2% air for 1 minute. It took 50 seconds for the water/gelatin weight ratio to reach 800% from the beginning of drying, 35 seconds from 800% to 200%, and 5 seconds from 200% to the finish of drying.

This material was wound up at 23° C. 40%, then cut in the same atmosphere, and sealed in a barrier bag which had been humidity conditioned for 6 hours, with a cardboard humidity conditioned at 23° C. 40% for 2 hours after having been humidity conditioned at 40° C. 10% for 8 hours, and samples shown in Table 1 were prepared.

The humidity in the barrier bag was 40%.

The composition per liter of the concentrated developing solution is shown below.

| | |
|---|---|
| Potassium Hydroxide | 60.0 g |
| Diethylenetriaminepentaacetic Acid | 3.0 g |
| Potassium Carbonate | 90.0 g |
| Sodium Metabisulfite | 105.0 g |
| Potassium Bromide | 10.5 g |
| Hydroquinone | 60.0 g |
| 5-Methylbenzotriazole | 0.53 g |
| 4-Hydroxymethyl-4-methyl-1-phenyl-3-pyrazolidone | 2.3 g |
| Sodium 3-(5-Mercaptotetrazol-1-yl)-benzenesulfonate | 0.15 g |
| Sodium Erythorbate | 6.0 g |
| Diethylene Glycol | 7.5 g |
| pH | 10.79 |

Mother solution is prepared by diluting 2 parts of the above concentrated solution with 1 part of water for use. The pH of the mother solution is 10.65. The replenishing solution is prepared by diluting 4 parts of the above concentrated solution with 3 parts of water and the pH of the replenishing solution is 10.62.

Developing solutions for test shown in Table 3 were prepared using this mother solution as a base. Comparative Compound B was the same as used in Example 1.

TABLE 3

| | Compound of Formula (I) | | Compound of Formula (II) | |
|---|---|---|---|---|
| No. of Developing Solution | Name of Compound | Addition Amount (g/liter) | Name of Compound | Addition Amount (g/liter) |
| 13 (Comparison) | — | — | — | — |
| 14 (Comparison) | — | — | II-1 | 6.0 |
| 15 (Comparison) | Comparative Compound C | 0.18 | II-1 | 6.0 |
| 16 (Comparison) | Comparative Compound B | 0.18 | II-1 | 6.0 |
| 17 (Invention) | I-20 | 0.24 | II-1 | 6.0 |

TABLE 3-continued

| No. of Developing Solution | Compound of Formula (I) Name of Compound | Compound of Formula (I) Addition Amount (g/liter) | Compound of Formula (II) Name of Compound | Compound of Formula (II) Addition Amount (g/liter) |
|---|---|---|---|---|
| 18 (Invention) | I-15 | 0.31 | II-3 | 7.2 |
| 19 (Invention) | I-23 | 0.29 | II-8 | 7.2 |
| 20 (Invention) | I-39 | 0.25 | II-18 | 6.0 |
| 21 (Invention) | I-32 | 0.29 | II-1 | 6.0 |
| 22 (Invention) | I-46 | 0.18 | II-1 | 6.0 |
| 23 (Comparison) | I-20 | 0.24 | II-1 | 0.5 |
| 24 (Comparison) | I-20 | 0.24 | II-1 | 14.4 |

Comparative Compound C

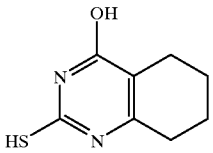

The fixing solution used was the same as used in Example 1.

Each of the thus-obtained samples was subjected to exposure through a continuous wedge with P-627FM printer (mercury) manufactured by Dai Nippon Screen Mfg. Co., Ltd., then underwent development processing at 38° C. for 20 seconds using the above developing solution, fixing, washing and drying.

Development was conducted using automatic processor FG-680AG, produced by Fuji Photo Film Co., Ltd.

Subsequently, running test was conducted using the above samples.

Running conditions were such that 60 sheets of 20% blackened large size films (50.8×61.0 cm) (two sheets of ten sheets had been exposed to light) were processed per one day, and running processing was continued for six days and stopped for one day, this procedure was repeated 3 times, then photographic properties and silver stain were evaluated.

Replenishing rate in development was described in Table 3 and that in fixation was 80 ml per one sheet of a large size film.

Evaluation of photographic properties and silver stain was conducted in the same manner as in Example 1.

The results of photographic properties and silver stain by running test are shown in Table 4 below.

TABLE 4

| Experiment No. | Developing Solution | Replenishing Rate (ml/m$^2$) | Photographic Properties | Running Properties Fresh Solution | Running Properties last | Silver Stain |
|---|---|---|---|---|---|---|
| 14 Comparison | 13 | 162 | Dmax | 5.52 | 5.50 | 2 |
| | | | Gradation | 21.0 | 23.0 | |
| | | | Sensitivity | 100 | 113 | |
| 15 Comparison | 14 | 162 | Dmax | 5.51 | 5.46 | 2 |
| | | | Gradation | 21.0 | 20.3 | |
| | | | Sensitivity | 101 | 99 | |
| 16 Comparison | 15 | 162 | Dmax | 5.20 | 5.10 | 2 |
| | | | Gradation | 18.0 | 17.5 | |
| | | | Sensitivity | 95 | 93 | |
| 17 Comparison | 15 | 484 | Dmax | 5.20 | 5.24 | 4 |
| | | | Gradation | 18.0 | 19.3 | |
| | | | Sensitivity | 95 | 95 | |
| 18 Comparison | 16 | 162 | Dmax | 4.75 | 4.10 | 4 |
| | | | Gradation | 14.3 | 13.9 | |
| | | | Sensitivity | 75 | 71 | |
| 19 Invention | 17 | 162 | Dmax | 5.50 | 5.48 | 5 |
| | | | Gradation | 21.0 | 20.1 | |
| | | | Sensitivity | 100 | 98 | |
| 20 Invention | 18 | 162 | Dmax | 5.32 | 5.21 | 4 |
| | | | Gradation | 19.5 | 19.1 | |
| | | | Sensitivity | 98 | 99 | |
| 21 Invention | 19 | 162 | Dmax | 5.38 | 5.35 | 4 |
| | | | Gradation | 21.5 | 20.6 | |
| | | | Sensitivity | 101 | 100 | |
| 22 Invention | 20 | 162 | Dmax | 5.44 | 5.33 | 4 |
| | | | Gradation | 20.1 | 20.9 | |
| | | | Sensitivity | 100 | 97 | |
| 23 Invention | 21 | 162 | Dmax | 5.45 | 5.31 | 4 |
| | | | Cradation | 19.8 | 19.2 | |
| | | | Sensitivity | 98 | 95 | |
| 24 Invention | 22 | 162 | Dmax | 5.55 | 5.36 | 5 |
| | | | Gradation | 23.0 | 21 | |
| | | | Sensitivity | 96 | 95 | |
| 25 | 23 | 162 | Dmax | 5.48 | 5.51 | 5 |

TABLE 4-continued

| Experiment No. | Developing Solution | Replenishing Rate (ml/m$^2$) | Running Properties: Photographic Properties | Fresh Solution | last | Silver Stain |
|---|---|---|---|---|---|---|
| Comparison | | | Gradation | 22.2 | 23.4 | |
| | | | Sensitivity | 102 | 112 | |
| 26 | 24 | 162 | Dmax | 5.42 | 5.11 | 5 |
| Comparison | | | Gradation | 24.2 | 23.1 | |
| | | | Sensitivity | 101 | 85 | |

It is apparently seen from the results in Table 4 that Experiment Nos. 14 to 17 which do not use the compound according to the present invention (formula (I)) generated conspicuous silver stain due to running processing and silver stain could not be improved without increasing replenishing rate. Experiment No. 18 was good in silver stain but photographic properties considerably deteriorated. It was found from Experiment Nos. 25 and 26, in which the amounts of the compound of the present invention (formula (II)) were varied, that silver stain was good but the sensitivity fluctuation due to running processing was large. In the experiment of the samples containing the compounds of the present invention (formulae (I) and (II)), both photographic properties and silver stain showed excellent results.

EXAMPLE 3

Preparation of Emulsion A

| | |
|---|---|
| **Solution 1** | |
| Water | 1 liter |
| Gelatin | 20 g |
| Sodium Chloride | 2.0 g |
| 1,3-Dimethylimidazolidine-2-thione | 20 mg |
| Sodium Benzenethiosulfonate | 8 mg |
| **Solution 2** | |
| Water | 400 ml |
| Silver Nitrate | 100 g |
| **Solution 3** | |
| Water | 400 ml |
| Sodium Chloride | 21.9 g |
| Potassium Bromide | 31.5 g |
| Ammonium Hexachloroiridate (III) (0.001% aqueous solution) | 10 ml |
| Potassium Hexachlororhodate (III) (0.001% aqueous solution) | 5 ml |

Solution 2 and Solution 3 were simultaneously added to Solution 1 maintained at 42° C. and pH 4.5 over a period of 15 minutes with stirring, and nucleus grains were formed. Subsequently, Solution 4 and Solution 5 shown below were added over a period of 15 minutes. Further, 0.15 g of potassium iodide was added thereto and grain formation was terminated.

| | |
|---|---|
| **Solution 4** | |
| Water | 400 ml |
| Silver Nitrate | 100 g |

-continued

| | |
|---|---|
| **Solution 5** | |
| Water | 400 ml |
| Sodium Chloride | 25.4 g |
| Potassium Bromide | 24.5 g |

The mixture was then washed according to an ordinary flocculation method and 62 g of gelatin was added.

The pH and pAg were adjusted to 5.9 and 7.5, respectively, and 2.0 mg of sodium thiosulfate, 8.0 mg of chloroauric acid, 2.0 mg of triphenylphosphine selenide, 4 mg of sodium benzenethiosulfonate, and 1 mg of sodium benzenethiosulfinate were added and optimal chemical sensitization was carried out at 60° C.

Further, 150 mg of 4-hydroxy-6-methyl-1,3,3a,7-tetraazaindene as a stabilizer and phenoxyethanol as a preservative were added to finally obtain cubic silver chloroiodobromide Emulsion A having a silver chloride content of 60 mol % and an average grain size of 0.24 $\mu$m.

Preparation of Coated Sample

To Emulsion A were added Sensitizing Dye (2) in an amount of $7.0\times10^{-4}$ mol/mol Ag and spectral sensitization was conducted. Further, KBr in an amount of $4.0\times10^{-3}$ mol/mol Ag, Compound (1) in an amount of $2.5\times10^{-4}$ mol/mol Ag, Compound (2) in an amount of $8.0\times10^{-4}$ mol/mol Ag, hydroquinone in an amount of $1.5\times10^{-2}$ mol/mol Ag, Compound (3-a) in an amount of $2.0\times10^{-4}$ mol/mol Ag, Compound (4) in an amount of $5.0\times10^{-4}$ mol/mol Ag, 40 wt %, based on gelatin, of polyethyl acrylate latex, 25 wt %, based on gelatin, of colloidal silica having a particle size of 10 m$\mu$, and 4 wt %, based on gelatin, of Compound (5) were added thereto. The thus-obtained coating solution was coated on a polyester support to provide a coated silver weight of 3.2 g/m$^2$ and a coated gelatin weight of 1.8 g/m$^2$. An upper protective layer and a lower protective layer each having the composition shown below were coated on this support.

Upper Protective Layer

| | |
|---|---|
| **Upper Protective Layer** | |
| Gelatin | 0.3 g/m$^2$ |
| Silica Matting Agent (average particle size: 5 $\mu$m) | 25 mg/m$^2$ |
| Compound (6) (gelatin dispersion) | 20 mg/m$^2$ |
| Colloidal Silica (particle size: 10 to 20 $\mu$m) | 30 mg/m$^2$ |
| Compound (7) | 5 mg/m$^2$ |
| Sodium Dodecylbenzenesulfonate | 20 mg/m$^2$ |

-continued

| | |
|---|---|
| Compound (8) | 20 mg/m$^2$ |
| Lower Protective Layer | |
| Gelatin | 0.5 g/m$^2$ |
| Compound (9) | 10 mg/m$^2$ |
| Compound (14) | 50 mg/m$^2$ |
| Compound (15) | 20 mg/m$^2$ |
| 1,5-Dihydroxy-2-benzaldoxime | 10 mg/m$^2$ |
| Polyethyl Acrylate Latex | 250 mg/m$^2$ |

The support of the sample which was used in the present invention had the backing layer and the backing protective layer having the following compositions.

Backing Layer

| | |
|---|---|
| Backing Layer | |
| Gelatin | 2.5 g/m$^2$ |
| Sodium Dodecylbenzenesulfonate | 30 mg/m$^2$ |
| Compound (11) | 50 mg/m$^2$ |
| Compound (12) | 30 mg/m$^2$ |
| Compound (13) | 30 mg/m$^2$ |
| Compound (16) | 90 mg/m$^2$ |
| Compound (5) | 140 mg/m$^2$ |
| Backing Protective Layer | |
| Gelatin | 1.0 g/m$^2$ |
| 1,3-Divinylsulfonyl-2-propanol | 20 mg/m$^2$ |
| Polymethyl Methacrylate Fine Grains (average particle size: 3.5 $\mu$m) | 10 mg/m$^2$ |
| Sodium Dodecylbenzenesulfonate | 20 mg/m$^2$ |

Sensitizing Dye (2)

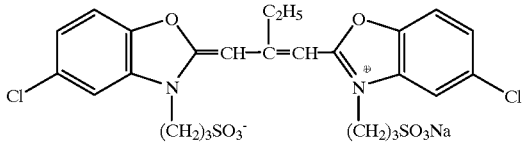

Compound (3-a)

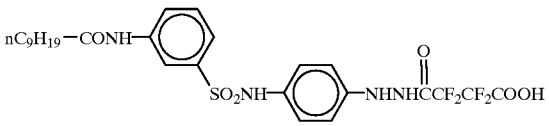

Compound (14)

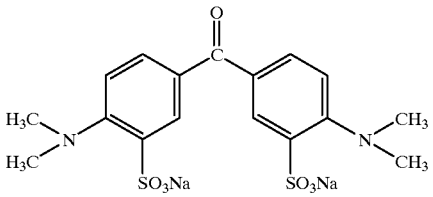

Compound (15)

$HO(CH_2CH_2O)_nCH_2CH_2OH$
(molecular weight: 1,000)

-continued

Compound (16)

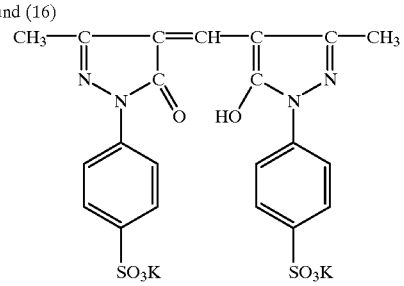

The composition of the solid developing agent is shown below.

| | |
|---|---|
| Sodium Hydroxide (beads, 99.5%) | 11.5 g |
| Potassium Sulfite (raw material powder) | 63.0 g |
| Sodium Sulfite (raw material powder) | 46.0 g |
| Potassium Carbonate | 62.0 g |
| Hydroquinone (briquette) | 40.0 g |
| The following are briquetted together. | |
| Diethylenetriaminepentaacetic Acid | 2.0 g |
| 5-Methylbenzenetriazole | 0.35 g |
| 4-Hydroxymethyl-4-methyl-1-phenyl-3-pyrazolidone | 1.5 g |
| Sodium 3-(5-Mercaptotetrazol-1-yl)-benzenesulfonate | 0.1 g |
| Potassium Bromide | 6.6 g |
| These components were dissolved in water to make | 1 liter |
| pH | 10.65 |

Developing solutions for test shown in Table 5 were prepared using this formulation as a base. Compounds added were the same as shown in Table 3.

TABLE 5

| | Compound of Formula (I) | | Compound of Formula (II) | |
|---|---|---|---|---|
| No. of Developing Solution | Name of Compound | Addition Amount (g/liter) | Name of Compound | Addition Amount (g/liter) |
| 25 (Comparison) | — | — | — | — |
| 26 (Comparison) | — | — | II-1 | 6.0 |
| 27 (Comparison) | Comparative Compound C | 0.18 | II-1 | 6.0 |
| 28 (Comparison) | Comparative Compound B | 0.18 | II-1 | 6.0 |
| 29 (Invention) | I-20 | 0.24 | II-1 | 6.0 |
| 30 (Invention) | I-15 | 0.31 | II-3 | 7.2 |
| 31 (Invention) | I-23 | 0.29 | II-8 | 7.2 |
| 32 (Invention) | I-39 | 0.25 | II-18 | 6.0 |
| 33 (Invention) | I-32 | 0.29 | II-1 | 6.0 |
| 34 (Invention) | I-45 | 0.18 | II-1 | 6.0 |
| 35 (Comparison) | I-20 | 0.24 | II-1 | 0.5 |
| 36 (Comparison) | I-20 | 0.24 | II-1 | 14.4 |

Raw material powders which were general industrial products were used as they were and beads of alkali metal salts were those commercially available.

Raw materials which were in the form of a briquette were compressed by the application of pressure using a briquetting machine and formed to a sheet, and they were crushed and used. With respect to small amount components, every components were blended and then made to a briquette.

Ten liter portion of the above processing chemicals was filled in a foldable container made of high density polyethylene and the takeout port was sealed with an aluminum seal. The dissolving and replenishing device having an automatic opening mechanism as disclosed in JP-A-9-138495 and JP-A-9-80718 was used for the dissolution and replenishment.

The formulation of the fixing solution was as follows. The composition of the solid fixing agent is shown below.

| Agent A (solid) | |
|---|---|
| Ammonium Thiosulfate (compact) | 125.0 g |
| Sodium Thiosulfuric Anhydride (raw material powder) | 19.0 g |
| Sodium Metabisulfite (raw material powder) | 18.0 g |
| Sodium Acetic Anhydride (raw material powder) | 42.0 g |
| Agent B (solution) | |
| Disodium Ethylenediaminetetraacetate Dihydrate | 0.03 g |
| Citric Anhydride | 3.7 g |
| Sodium Gluconate | 1.7 g |
| Aluminum Sulfate | 8.4 g |
| Sulfuric Acid | 2.1 g |

-continued

| | |
|---|---|
| These components were dissolved in water to make | 50 ml |
| Agents A and B were dissolved in water to make | 1 liter |
| pH | 4.85 |

Flakes of ammonium thiosulfate (compact) produced by a spray drying method were compressed by the application of pressure using a roller compactor and crushed to an amorphous chips having a length of about 4 to 6 mm, then blended with sodium thiosulfuric anhydride. As to other raw material powders, general industrial products were used.

Ten liter portion of each of Agent A and Agent B was filled in a foldable container made of high density polyethylene and the takeout port of Agent A was sealed with an aluminum seal. The mouth of the container of Agent B was sealed with a screw cap. The dissolving and replenishing device having an automatic opening mechanism as disclosed in JP-A-9-80718 and JP-A-9-138495 was used for the dissolution and replenishment.

Each sample produced was exposed with tungsten light of 3,200° K. through a step wedge, and subjected to development processing at 35° C. for 30 sec. using the developing solution having the composition described above, then fixation, washing and drying. Processing was conducted using automatic processor FG-710F, produced by Fuji Photo Film Co., Ltd.

Evaluation of running properties and silver stain was conducted in the same manner as in Example 2. The results obtained are shown in Table 6 below, which were the same as in Example 2.

TABLE 6

| | | Replenishing | Running Properties | | | |
|---|---|---|---|---|---|---|
| Experiment No. | Developing Solution | Rate ($ml/m^2$) | Photographic Properties | Fresh Solution | last | Silver Stain |
| 27 | 25 | 162 | Dmax | 5.34 | 5.41 | 2 |
| Comparison | | | Gradation | 26.3 | 25.4 | |
| | | | Sensitivity | 100 | 110 | |
| 28 | 26 | 162 | Dmax | 5.33 | 5.14 | 2 |
| Comparison | | | Gradation | 26.1 | 21.1 | |
| | | | Sensitivity | 99 | 96 | |
| 29 | 27 | 162 | Dmax | 5.11 | 5.00 | 2 |
| Comparison | | | Gradation | 21.3 | 16.4 | |
| | | | Sensitivity | 96 | 94 | |
| 30 | 27 | 484 | Dmax | 5.11 | 5.24 | 4 |
| Comparison | | | Gradation | 21.3 | 21.0 | |
| | | | Sensitivity | 96 | 96 | |
| 31 | 28 | 162 | Dmax | 4.60 | 4.03 | 4 |
| Comparison | | | Gradation | 13.3 | 10.8 | |
| | | | Sensitivity | 71 | 68 | |
| 32 | 29 | 162 | Dmax | 5.33 | 5.15 | 5 |
| Invention | | | Gradation | 24.1 | 23.4 | |
| | | | Sensitivity | 100 | 99 | |
| 33 | 30 | 162 | Dmax | 5.11 | 5.02 | 4 |
| Invention | 30 | 162 | Gradation | 18.5 | 16.3 | |
| | | | Sensitivity | 96 | 93 | |
| 34 | 31 | 162 | Dmax | 5.33 | 5.28 | 4 |
| Invention | | | Gradation | 24.3 | 20.0 | |
| | | | Sensitivity | 98 | 95 | |
| 35 | 32 | 162 | Dmax | 5.25 | 5.21 | 4 |
| Invention | | | Gradation | 21.4 | 22.3 | |
| | | | Sensitivity | 101 | 98 | |
| 36 | 33 | 162 | Dmax | 5.23 | 5.1 | 4 |

TABLE 6-continued

| Experiment No. | Developing Solution | Replenishing Rate (ml/m$^2$) | Running Properties: Photographic Properties | Fresh Solution | last | Silver Stain |
|---|---|---|---|---|---|---|
| Invention | | | Gradation | 19.5 | 18 | |
| | | | Sensitivity | 97 | 94 | |
| 37 | 34 | 162 | Dmax | 5.34 | 5.08 | 5 |
| Invention | | | Gradation | 24.0 | 22.7 | |
| | | | Sensitivity | 99 | 95 | |
| 38 | 35 | 162 | Dmax | 5.42 | 5.22 | 5 |
| Comparison | | | Gradation | 22.2 | 23.4 | |
| | | | Sensitivity | 101 | 98 | |
| 39 | 36 | 162 | Dmax | 5.29 | 5.11 | 5 |
| Comparison | | | Gradation | 22.1 | 20.1 | |
| | | | Sensitivity | 99 | 83 | |

When a silver halide photographic material is processed according to the method of the present invention with a stable developing solution containing the compound represented by formulae (I) and (II) of the present invention having pH of less than 11.0, the silver stain generated during development processing can be reduced without impairing photographic properties.

While the invention has been described in detail and with reference to specific examples thereof, it will be apparent to one skilled in the art that various changes and modifications can be made therein without departing from the spirit and scope thereof.

What is claimed is:

1. A development processing method comprising a step of developing a silver halide photographic material having at least one silver halide emulsion layer with a developing solution containing a hydroquinone developing agent, wherein said developing solution has a pH of from 9.0 to 11.0, and contains a compound represented by formula (A) or (B) in an amount of at least 0.1 mmol per liter thereof and a compound represented by formula (II) in a concentration ratio of the compound represented by formula (II)/the hydroquinone developing agent of from 0.03 to 0.12:

(A)

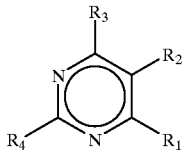

(B)

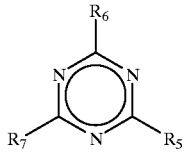

wherein in formula (A), $R_1$, $R_2$, $R_3$ and $R_4$ each represents a hydrogen atom, a halogen atom or a substituent which is bonded to the ring in formula (A) by a carbon atom, a nitrogen atom, an oxygen atom, a sulfur atom or a phosphorus atom contained in the substituent, provided that at least two of $R_1$ to $R_4$ represent an —SM group, wherein M represents a hydrogen atom, an alkali metal atom or an ammonium group;

wherein in formula (B), $R_5$, $R_6$, and $R_7$ each represents a hydrogen atom, a halogen atom or a substituent which is bonded to the ring in formula (B) by a carbon atom, a nitrogen atom, an oxygen atom, a sulfur atom or a phosphorus atom contained in the substituent, provided that at least two of $R_5$ to $R_7$ represent an —SM group, wherein M represents a hydrogen atom, an alkali metal atom or an ammonium group;

(II)

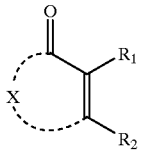

wherein in formula (II), $R_1$ and $R_2$ each represents a hydroxyl group, an amino group, an acylamino group, an alkylsulfonylamino group, an arylsulfonylamino group, an alkoxycarbonylamino group, a mercapto group or an alkylthio group; and X comprises at least one of a carbon atom, an oxygen atom and a nitrogen atom and forms a 5- or 6-membered ring together with the two vinyl carbons on which $R_1$ and $R_2$ are substituted and the carbonyl carbon.

2. The development processing method of claim 1, wherein the development is carried out while replenishing said developing solution in a replenishing rate of 330 ml/m$^2$ or less.

3. The development processing method of claim 1, wherein said developing solution is prepared using solid processing agents.

4. The development processing method of claim 1, wherein said developing solution contains the compound represented by formula (A) or (B) in an amount of from 0.1 to 5 mmol per liter thereof.

5. The development processing method of claim 1, wherein the silver halide in the silver halide emulsion of said silver halide photographic material has a silver chloride content of 50 mol % or more.

6. The development processing method of claim 1, wherein the hydroquinone developing agent contained in said developing solution is hydroquinone.

7. The development processing method of claim 1, wherein the compound represented by formula (A) or (B) is a compound represented by formula (A).

8. The development processing method of claim 1, wherein the compound represented by formula (A) or (B) is a compound represented by formula (B).

* * * * *